US007306529B2

(12) United States Patent
Kennedy, III et al.

(10) Patent No.: US 7,306,529 B2
(45) Date of Patent: Dec. 11, 2007

(54) MULTI-LAYER GOLF BALL

(75) Inventors: Thomas J. Kennedy, III, Wilbraham, MA (US); Mark K. Binette, Ludlow, MA (US); Vincent J. Simonds, Brimfield, MA (US); Michael J. Tzivanis, Chicopee, MA (US); David M. Melanson, Northampton, MA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 11/245,757

(22) Filed: Oct. 7, 2005

(65) Prior Publication Data

US 2007/0105659 A1 May 10, 2007

(51) Int. Cl.
*A63B 37/06* (2006.01)

(52) U.S. Cl. ..... 473/376

(58) Field of Classification Search ..... 473/376, 473/373, 374

See application file for complete search history.

(56) References Cited

U.S. PATENT DOCUMENTS

| | | | |
|---|---|---|---|
| 2,741,480 | A | 4/1956 | Smith |
| 2,973,800 | A | 3/1961 | Muccino |
| 3,053,539 | A | 9/1962 | Picchowski |
| 3,264,272 | A | 8/1966 | Rees |
| 3,313,545 | A | 4/1967 | Bartsch |
| 3,373,123 | A | 3/1968 | Brice |
| 3,384,612 | A | 5/1968 | Brandt et al. |
| 3,395,109 | A | 7/1968 | Molitor et al. |
| 3,458,205 | A | 7/1969 | Smith et al. |
| 3,502,338 | A | 3/1970 | Cox |
| 3,534,965 | A | 10/1970 | Harrison et al. |
| 3,572,721 | A | 3/1971 | Harrison et al. |
| 3,883,145 | A | 5/1975 | Cox et al. |
| 3,979,126 | A | 9/1976 | Dusbiber |
| 3,989,568 | A | 11/1976 | Isaac |
| 4,076,255 | A | 2/1978 | Moore et al. |
| 4,085,937 | A | 4/1978 | Schenk |
| 4,123,061 | A | 10/1978 | Dusbiber |
| 4,190,711 | A | 2/1980 | Zdrahala et al. |
| 4,218,543 | A | 8/1980 | Weber et al. |
| 4,248,432 | A | 2/1981 | Hewitt et al. |
| 4,272,079 | A | 6/1981 | Nakade et al. |
| 4,274,637 | A | 6/1981 | Molitor |
| 4,337,946 | A | 7/1982 | Saito et al. |
| 4,431,193 | A | 2/1984 | Nesbitt |
| 4,442,282 | A | 4/1984 | Kolycheck |
| 4,570,937 | A | 2/1986 | Yamada |
| 4,582,887 | A | 4/1986 | Dominguez et al. |
| 4,590,219 | A | 5/1986 | Nissen et al. |
| 4,607,090 | A | 8/1986 | Dominguez |
| 4,650,193 | A | 3/1987 | Molitor et al. |
| 4,674,751 | A | 6/1987 | Molitor et al. |
| 4,679,795 | A | 7/1987 | Melvin et al. |
| 4,688,801 | A | 8/1987 | Reiter |
| 4,690,981 | A | 9/1987 | Slatz |

(Continued)

*Primary Examiner*—Raeann Trimiew
(74) *Attorney, Agent, or Firm*—Michael A. Catania; Elaine H. Lo

(57) ABSTRACT

A golf ball comprises a molded core, one or more ionomer mantles, and a thermoset polyurethane cover. The core is a high cis-polybutadiene crosslinked with zinc diacrylate and may also comprise a halogenated thiophenol and metal thiosulfate. One or more of the ionomer mantles comprises an ionomer neutralized to 80% or greater.

23 Claims, 1 Drawing Sheet

U.S. PATENT DOCUMENTS 4,695,055 A 9/1987 Newcomb et al.
4,714,253 A 12/1987 Nakahara et al.
4,762,322 A 8/1988 Molitor et al.
4,798,386 A 1/1989 Berard
4,848,770 A 7/1989 Shama
4,852,884 A 8/1989 Sullivan
4,858,923 A 8/1989 Gobush et al.
4,858,924 A 8/1989 Saito et al.
4,878,674 A 11/1989 Newcomb et al.
4,884,814 A 12/1989 Sullivan
4,911,451 A 3/1990 Sullivan et al.
4,919,434 A 4/1990 Saito
4,957,297 A 9/1990 Newcomb et al.
4,979,746 A 12/1990 Gentiluomo
4,984,804 A 1/1991 Yamada et al.
4,986,545 A 1/1991 Sullivan
5,002,281 A 3/1991 Nakahara et al.
5,006,297 A 4/1991 Brown et al.
5,019,319 A 5/1991 Nakamura et al.
5,026,067 A 6/1991 Gentiluomo
5,035,425 A 7/1991 Edwards
5,045,591 A 9/1991 Meyer et al.
5,048,838 A 9/1991 Chikaraishi et al.
5,068,151 A 11/1991 Nakamura
5,072,944 A 12/1991 Nakahara et al.
5,096,201 A 3/1992 Egashira et al.
5,098,105 A 3/1992 Sullivan
5,104,126 A 4/1992 Gentiluomo
5,120,791 A 6/1992 Sullivan
5,142,835 A 9/1992 Mrocca
5,150,906 A 9/1992 Molitor et al.
5,156,405 A 10/1992 Kitaoh et al.
5,184,828 A 2/1993 Kim et al.
5,187,013 A 2/1993 Sullivan
5,197,740 A 3/1993 Pocklington et al.
5,219,973 A 6/1993 Slack et al.
5,222,739 A 6/1993 Horiuchi et al.
5,244,969 A 9/1993 Yamada
5,253,871 A 10/1993 Viollaz
5,273,286 A 12/1993 Sun
5,273,287 A 12/1993 Molitor et al.
5,274,041 A 12/1993 Yamada
5,281,651 A 1/1994 Arjunan et al.
5,300,334 A 4/1994 Niederst et al.
5,304,608 A 4/1994 Yabuki et al.
5,306,760 A 4/1994 Sullivan
5,312,857 A 5/1994 Sullivan
5,314,187 A 5/1994 Proudfit
5,324,783 A 6/1994 Sullivan
5,330,837 A 7/1994 Sullivan
5,334,673 A 8/1994 Wu
5,338,610 A 8/1994 Sullivan
5,368,304 A 11/1994 Sullivan et al.
5,368,806 A 11/1994 Harasin et al.
5,387,750 A 2/1995 Chiang
5,403,010 A 4/1995 Yabuki et al.
5,439,227 A 8/1995 Egashira et al.
5,480,155 A 1/1996 Molitor et al.
5,482,285 A 1/1996 Yabuki et al.
5,484,870 A 1/1996 Wu
5,490,673 A 2/1996 Hiraoka
5,490,674 A 2/1996 Hamada et al.
5,492,972 A 2/1996 Stefani
5,553,852 A 9/1996 Higuchi et al.
5,586,950 A 12/1996 Endo
5,628,699 A 5/1997 Maruko et al.
5,668,239 A 9/1997 Nodelman et al.
5,674,137 A 10/1997 Maruko et al.
5,688,191 A 11/1997 Cavallaro et al.
5,692,974 A 12/1997 Wu et al.
5,730,665 A 3/1998 Shimosaka et al.
5,733,206 A 3/1998 Nesbitt et al.
5,733,207 A 3/1998 Sullivan et al.
5,733,428 A 3/1998 Calabria et al.
5,739,247 A 4/1998 Lesko et al.
5,739,253 A 4/1998 Nodelman et al.
5,750,580 A 5/1998 Mayer et al.
5,759,676 A 6/1998 Cavallaro et al.
5,779,561 A 7/1998 Sullivan et al.
5,779,562 A 7/1998 Melvin et al.
5,779,563 A 7/1998 Yamagishi et al.
5,783,293 A 7/1998 Lammi
5,792,008 A 8/1998 Kakiuchi et al.
5,797,808 A 8/1998 Hayashi et al.
5,800,284 A 9/1998 Sullivan et al.
5,803,831 A 9/1998 Sullivan et al.
5,810,678 A 9/1998 Cavallaro et al.
5,813,923 A 9/1998 Cavallaro et al.
5,816,937 A 10/1998 Shimosaka et al.
5,820,488 A 10/1998 Sullivan et al.
5,820,489 A 10/1998 Sullivan et al.
5,820,491 A 10/1998 Hatch et al.
5,827,167 A 10/1998 Dougan et al.
5,830,087 A 11/1998 Sullivan et al.
5,833,553 A 11/1998 Sullivan et al.
5,833,554 A 11/1998 Sullivan et al.
5,836,833 A 11/1998 Shimosaka et al.
5,849,168 A 12/1998 Lutz
5,856,388 A 1/1999 Harris et al.
5,863,264 A 1/1999 Yamagishi et al.
5,873,796 A 2/1999 Cavallaro et al.
5,885,172 A 3/1999 Hebert et al.
5,888,437 A 3/1999 Calabria et al.
5,891,973 A 4/1999 Sullivan et al.
5,897,884 A 4/1999 Calabria et al.
5,899,822 A 5/1999 Yamagishi et al.
5,902,192 A 5/1999 Kashiwagi et al.
5,908,358 A 6/1999 Wu
5,919,100 A 7/1999 Boehm et al.
5,919,862 A 7/1999 Rajagopalan et al.
5,922,252 A 7/1999 Stanton et al.
5,929,189 A 7/1999 Ichikawa et al.
5,935,021 A 8/1999 Kashiwagi et al.
5,947,842 A 9/1999 Cavallaro et al.
5,947,843 A 9/1999 Calabria et al.
5,959,059 A 9/1999 Vedula et al.
5,976,035 A 11/1999 Umezawa et al.
5,984,807 A 11/1999 Wai et al.
6,315,684 B1 * 11/2001 Binette et al. ..... 473/377
6,419,594 B1 * 7/2002 Nesbitt et al. ..... 473/371
6,635,716 B2 * 10/2003 Voorheis et al. ..... 525/261
2005/0245652 A1 * 11/2005 Bulpett et al. ..... 524/289

* cited by examiner

MULTI-LAYER GOLF BALL

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present disclosure relates, in various embodiments, to multi-layer golf balls. The golf balls exhibit enhanced combinations of compression, resilience, and durability properties. Methods of preparing such golf balls are also disclosed.

2. Description of the Related Art

For many years, golf balls have been categorized into three different groups. These groups are, namely, one-piece or unitary balls, wound balls, and multi-piece solid balls.

A one-piece ball typically is formed from a solid mass of moldable material, such as an elastomer, which has been cured to develop the necessary degree of hardness, durability, etc., desired. The one-piece ball generally possesses the same overall composition between the interior and exterior of the ball. One piece balls are described, for example, in U.S. Pat. No. 3,313,545; U.S. Pat. No. 3,373,123; and U.S. Pat. No. 3,384,612.

A wound ball has frequently been referred to as a "three-piece ball" since it is produced by winding vulcanized rubber thread under tension around a solid or semi-solid center to form a wound core. The wound core is then enclosed in a single or multi-layer covering of tough protective material. Until relatively recently, the wound ball was desired by many skilled, low handicap golfers due to a number of characteristics.

For example, the three-piece wound ball was previously produced utilizing a balata, or balata like, cover which is relatively soft and flexible. Upon impact, it compresses against the surface of the club producing high spin. Consequently, the soft and flexible balata covers along with wound cores provide an experienced golfer with the ability to apply a spin to control the ball in flight in order to produce a draw or a fade or a backspin which causes the ball to "bite" or stop abruptly on contact with the green. Moreover, the balata cover produces a soft "feel" to the low handicap player. Such playability properties of workability, feel, etc., are particularly important in short iron play and low swing speeds and are exploited significantly by highly skilled players.

However, a three-piece wound ball has several disadvantages both from a manufacturing standpoint and a playability standpoint. In this regard, a thread wound ball is relatively difficult to manufacture due to the number of production steps required and the careful control which must be exercised in each stage of manufacture to achieve suitable roundness, velocity, rebound, "click", "feel", and the like.

Additionally, a soft thread wound (three-piece) ball is not well suited for use by the less skilled and/or high handicap golfer who cannot intentionally control the spin of the ball. For example, the unintentional application of side spin by a less skilled golfer produces hooking or slicing. The side spin reduces the golfer's control over the ball as well as reduces travel distance.

Similarly, despite all of the benefits of balata, balata covered balls are easily "cut" and/or damaged if miss-hit. Consequently, golf balls produced with balata or balata containing cover compositions can exhibit a relatively short life span. As a result of this negative property, balata and its synthetic substitute, trans-polyisoprene, and resin blends, have been essentially replaced as the cover materials of choice by golf ball manufacturers by materials comprising ionomeric resins and other elastomers such as polyurethanes.

Multi-piece solid golf balls, on the other hand, include a solid resilient core and a cover having single or multiple layers employing different types of material molded on the core. The core can also include one or more layers. Additionally, one or more intermediate, or mantle, layers can also be included between the core and cover layer(s).

By utilizing different types of materials and different construction combinations, multi-piece solid golf balls have now been designed to match and/or surpass the beneficial properties produced by three-piece wound balls. Additionally, the multi-piece solid golf balls do not possess the manufacturing difficulties, etc., that are associated with the three-piece wound balls.

The one-piece golf ball and the solid core for a multi-piece solid (non-wound) ball frequently are formed from a combination of elastomeric materials such as polybutadiene and other rubbers that are cross-linked. These materials are molded under high pressure and temperature to provide a ball or core of suitable compression and resilience. The cover or cover layers typically contain a substantial quantity of ionomeric resins that impart toughness and cut resistance to the covers. Additional cover materials include synthetic balatas, polyurethanes, and blends of ionomers with polyurethanes, etc.

As a result, a wide variety of multi-piece solid golf balls are now commercially available to suit an individual player's game. In essence, different types of balls have been, and are being, specifically designed to suit various skill levels. Moreover, improved golf balls are continually being produced by golf ball manufacturers with technological advancements in materials and manufacturing processes.

In this regard, the composition of the core or center of a golf ball is important in that it affects several characteristics (i.e., playability, durability, etc.) of the ball. Additionally, it provides resilience to the golf ball, while also providing many desirable properties to both the core and the overall golfball, including weight, compression, distance, etc. Similarly, the mantle layers affect, among other things, the compression and resilience of the overall golf ball. The composition of the cover layer affects the spin, feel, resilience, and playability properties of the ball.

Due to the continuous importance of improving the properties of a golf ball, it would be beneficial to make a multi-layer golf ball that exhibits improved properties, particularly improved combinations of compression, resilience, and durability.

These and other non-limiting objects and features of the disclosure will be apparent from the following description and from the claims.

BRIEF SUMMARY OF THE INVENTION

Disclosed herein, in various embodiments, are multi-layer golf balls. The embodiments exhibit enhanced combinations of compression, resilience, and durability properties. In particular, the golf balls have such characteristics as excellent feel and distance, low driver spin, high initial velocity, excellent green-side spin, improved adhesion between the layers, and excellent processability. The multi-layer golfballs comprise a core, a mantle layer, and a polyurethane/polyurea cover. Furthermore, the multi-layer golfballs may comprise a core, an inner mantle, an ionomer outer mantle or skin, and a polyurethane/polyurea cover. The golf balls of the present invention may also comprise a multi-layer core, one or more mantle layers mantle, and a polyurethane/polyurea cover.

In exemplary embodiments, the core comprises a high cis-polybutadiene crosslinked with a difunctional acrylate. In further embodiments, the polybutadiene is a mid to high Mooney viscosity polybutadiene or blends thereof. This results in a soft, enhanced velocity core. The polybutadiene preferably has a Mooney viscosity of about 35 or more, including from about 35 to about 70. In other embodiments, the solid core further comprises a peptizer and/or a thiosynergist to further increase the resilience and softness of the core. The peptizer may be a halogenated thiophenol, such as pentachlorothiophenol, or its metal salt. The thiosynergist may be disodium hexamethylene bis(thiosulfate) dehydrate (DHTS). In further embodiments, the core is a soft, high velocity core. It has a compression (Instron) of greater than 0.0880, including greater than 0.0900 and 0.0950.

In exemplary embodiments comprising more than one inner cover layer, either the inner mantle or the outer mantle comprises a highly neutralized ionomer material, such as a highly neutralized ethylene copolymer or terpolymer. In further exemplary embodiments comprising a single mantle layer, the mantle comprises a highly neutralized ionomer material, such as a highly neutralized ethylene copolymer or terpolymer. In further embodiments, the ionomer is neutralized to 80% or more. These thermoplastic materials produce a relatively soft, low compression inner mantle with high resilience. In other embodiments, the ionomer has been modified with a fatty acid, such as stearic acid, oleic acid, or metal stearate/oleate additive. It may also have a starting material that is a terpolymer or a copolymer. In such embodiments, ethylene acrylic acid, or methacrylate, and ethylene acrylates may be used as the starting material. The inner mantle has a Shore D hardness of from about 30 to about 75, including from about 50 to about 70.

In exemplary embodiments comprising more than one inner layer, either the inner mantle or outer mantle or skin comprises ionomers or ionomer blends. The other mantle or skin has a high flex modulus. Additionally, the ionomer outer mantle or skin adheres well to the inner mantle and the polyurethane/polyurea cover.

In exemplary embodiments, the polyurethane/polyurea cover comprises a thermoset material. The cover can be produced by cast or reaction injection molding (RIM). The cover has a Shore B hardness of from about 20 to about 95 including from about 60 to about 90.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
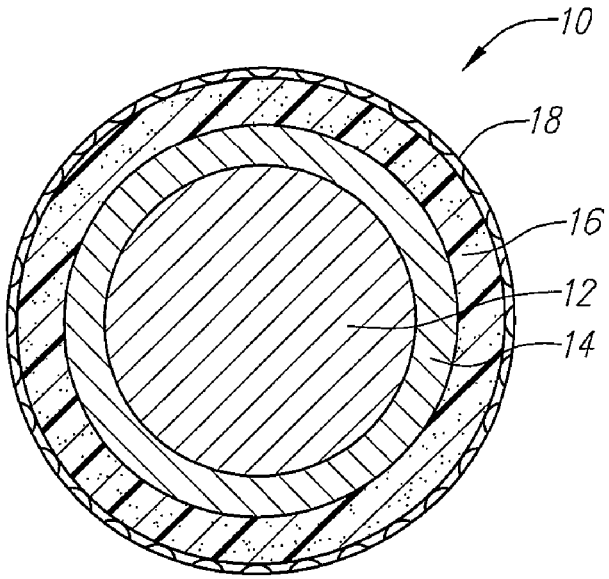
FIG. 1 is a cross-sectional view of a preferred embodiment of a golf ball.

Disclosed herein, in various embodiments, are multi-layered golf balls having improved structural configurations and characteristics. The balls exhibit low spin when struck by a driver off the tee and high initial velocity resulting in increased distance. Furthermore, the balls produce high spin around the green when struck with a high lofted club. These are characteristics that are generally desirable to skilled golfers, i.e., low driver spin off the tee, and high spin and enhanced playability green-side. The balls also exhibit excellent processing and durability characteristics.

A more complete understanding of the compositions, products, processes and apparatuses disclosed herein can be obtained by reference to the accompanying drawings. These figures are merely schematic representations based on convenience and the present development, and are, therefore, not intended to indicate relative size and dimensions of the golf balls and/or components thereof.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to component of like function.

Figure 2:
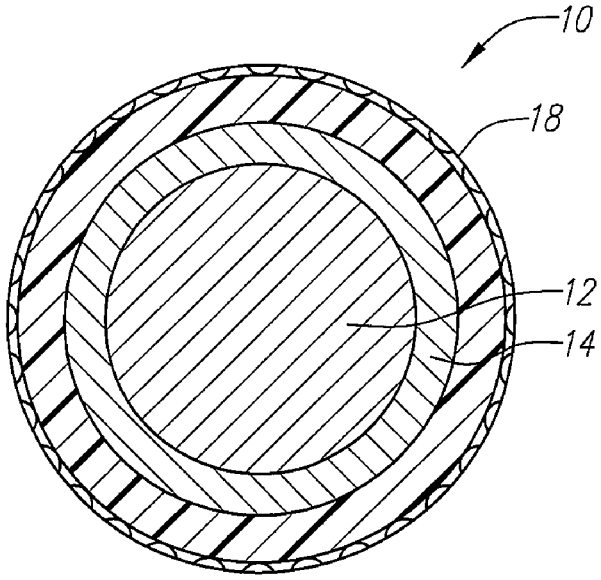
FIG. 2 is a cross-sectional view of an alternative embodiment of a golf ball.

Referring to FIG. 1, a multi-layer golf ball 10 is illustrated. In this embodiment, golf ball 10 comprises a core 12, an inner mantle 14, an outer mantle or skin 16, and a cover 18. Referring to FIG. 2, the golf ball 10 comprises a core 12, an inner mantle 14 and a cover 18.

The core 12, is preferably a soft, high resilience, molded core comprising a high cis-polybutadiene having a Mooney viscosity of from about 20 to about 70, more preferably from 35 to about 70, and optionally a peptizer such as pentachlorothiophenol or a metallic salt thereof and/or a metal thiosulfate. The molded core has an Instron compression of greater than 0.0880, including an Instron compression of about 0.0900 to about 0.1150 and a resilience of from about 0.760 to about 0.820, including from about 0.770 to about 0.810.

The inner mantle 14 preferably comprises a highly neutralized ionomer, i.e., an ionomer neutralized to 80% or more, including from about 90% to about 100%. Optionally, the highly neutralized ionomer is modified with a fatty acid or a salt thereof. Preferably, the ionomer comprises a copolymer or terpolymer of ethylene and ethylene acrylate neutralized to 80% or more. The inner mantle 14 has a Shore D hardness of from about 30 to about 80, including from about 50 to about 75. This layer may be injection or compression molded. Furthermore, it may undergo any various post-processing steps know to those skilled in the art i.e centerless grinding, treatment with plasma, treatment with an adhesion promoter, etc.

The outer mantle or skin 16 comprises an ionomer resin or blends thereof. The ionomer skin has a flex modulus of from about 1 to about 100 kpsi, including from about 10 to about 75 kpsi. Additionally, the ionomer skin exhibits good adhesive properties with the inner mantle 14 and the cover 18. This layer may be injection or compression molded. Furthermore, it may undergo any various post-processing steps know to those skilled in the art i.e centerless grinding, treatment with plasma, treatment with an adhesion promoter, etc.

In a further exemplary embodiment, according to FIG. 1, the inner mantle 14 comprises an ionomer resin or blends thereof. The ionomer mantle has a flex modulus of from about 1 to about 100 kpsi, including from about 20 to about 75 kpsi. Furthermore, the outer mantle or skin 16 comprises a highly neutralized ionomer, i.e., an ionomer neutralized to 80% or more, including from about 90% to about 100%. Optionally, the highly neutralized ionomer is modified with a fatty acid or a salt thereof. Preferably, the ionomer comprises a copolymer or terpolymer of ethylene and ethylene acrylate neutralized to 80% or more. The outer mantle or skin 16 has a Shore D hardness of from about 30 to about 80, including from about 50 to about 75. Either layer may be injection or compression molded. Furthermore, either layer may undergo any various post-processing steps know to those skilled in the art i.e centerless grinding, treatment with plasma, treatment with an adhesion promoter, etc.

The cover 18 is a thermoset polyurethane/polyurea cover. Preferably the cover is a thermoset polyurethane/polyurea cover as produced by reaction injection molding. The cover preferably has a flex modulus in the range of from about 1 to about 310 kpsi, a Shore B hardness in the range from about 20 to about 95, a thickness in the range from about 0.005" to about 0.050", and shows good scuff resistance and good cut resistance.

Two principal properties involved in golf ball performance are resilience and compression. Resilience is determined by the coefficient of restitution (COR), i.e., the constant "e" which is the ratio of the relative velocity of an elastic sphere after direct impact to that before impact. As a result, the coefficient of restitution ("e") can vary from 0 to 1, with 1 being equivalent to a perfectly or completely elastic collision and 0 being equivalent to a perfectly or completely inelastic collision.

Resilience, along with additional factors such as club head speed, angle of trajectory and ball configuration (i.e., dimple pattern) generally determines the distance a ball will travel when hit. Since club head speed and the angle of trajectory are factors not easily controllable by a manufacturer, factors of concern among manufacturers are the COR and the surface configuration of the ball.

The COR in solid core balls is a function of the composition of the molded core and of the cover. In balls containing a wound core (i.e., balls comprising a. liquid or solid center, elastic windings, and a cover), the COR is a function of not only the composition of the center and the cover, but also the composition and tension of the elastomeric windings.

The COR is the ratio of the outgoing velocity to the incoming velocity. In the examples of this application, the COR of a golf ball was measured by propelling a ball horizontally at a speed of 125±1 feet per second (fps) against a generally vertical, hard, flat steel plate and measuring the ball's incoming and outgoing velocity electronically. Speeds were measured with a pair of Ohler Mark 55 ballistic screens, which provide a timing pulse when an object passes through them. The screens are separated by 36 inches and are located 25.25 inches and 61.25 inches from the rebound wall. The ball speed was measured by timing the pulses from screen 1 to screen 2 on the way into the rebound wall (as the average speed of the ball over 36 inches), and then the exit speed was timed from screen 2 to screen 1 over the same distance. The rebound wall was tilted 2 degrees from a vertical plane to allow the ball to rebound slightly downward in order to miss the edge of the cannon that fired it.

As indicated above, the incoming speed should be 125±1 fps. Furthermore, the correlation between COR and forward or incoming speed has been studied and a correction has been made over the ±1 fps range so that the COR is reported as if the ball had an incoming speed of exactly 125.0 fps.

The COR must be carefully controlled in all commercial golfballs if the ball is to be within the specifications regulated by the United States Golf Association (U.S.G.A.). U.S.G.A. standards indicate that a "regulation" ball cannot have an initial velocity (i.e., the speed off the club) exceeding 255 feet per second in an atmosphere of 75° F. when tested on a U.S.G.A. machine. Since the COR of a ball is related to the ball's initial velocity, it is highly desirable to produce a ball having sufficiently high COR to closely approach the U.S.G.A. limit on initial velocity, while having an ample degree of softness (i.e., hardness) to produce enhanced playability (i.e., spin, etc.).

As indicated above, compression is another important property involved in the performance of a golf ball. The compression of the ball can affect the playability of the ball on striking and the sound or "click" produced. Similarly, compression can affect the "feel" of the ball (i.e., hard or soft responsive feel), particularly in chipping and putting.

Moreover, while compression itself has little bearing on the distance performance of a ball, compression can affect the playability of the ball on striking. The degree of compression of a ball against the club face and the softness of the cover strongly influence the resultant spin rate. Typically, a softer cover will produce a higher spin rate than a harder cover. Additionally, a harder core will produce a higher spin rate than a softer core. This is because at impact a hard core serves to compress the cover of the ball against the face of the club to a much greater degree than a soft core thereby resulting in more "grab" of the ball on the clubface and subsequent higher spin rates. In effect, the cover is squeezed between the relatively incompressible core and clubhead. When a softer core is used, the cover is under much less compressive stress than when a harder core is used and therefore does not contact the clubface as intimately. This results in lower spin rates.

The term "compression" utilized in the golf ball trade generally defines the overall deflection that a golf ball undergoes when subjected to a compressive load. For example, compression indicates the amount of change in golf ball's shape upon striking. The development of solid core technology in two-piece or multi-piece solid balls has allowed for much more precise control of compression in comparison to thread wound three-piece balls. This is because in the manufacture of solid core balls, the amount of deflection or deformation is precisely controlled by the chemical formula used in making the cores. This differs from wound three-piece balls wherein compression is controlled in part by the winding process of the elastic thread. Thus, two-piece and multi-layer solid core balls exhibit much more consistent compression readings than balls having wound cores such as the thread wound three-piece balls.

In the past, PGA compression related to a scale of from 0 to 200 given to a golf ball. The lower PGA compression value, the softer the feel of the ball upon striking. In practice, tournament quality balls have compression ratings around 40 to 110, and preferably around 50 to 100.

In determining PGA compression using the 0 to 200 scale, a standard force is applied to the external surface of the ball. A ball which exhibits no deflection (0.0 inches in deflection) is rated 200 and a ball which deflects 2/10th of an inch (0.2 inches) is rated 0. Every change of 0.001 of an inch in deflection represents a 1 point drop in compression. Consequently, a ball which deflects 0.1 inches (100×0.001 inches) has a PGA compression value of 100 (i.e., 200 to 100) and a ball which deflects 0.110 inches (110×0.001 inches) has a PGA compression of 90 (i.e., 200 minus 110).

In order to assist in the determination of compression, several devices have been employed by the industry. For example, PGA compression is determined by an apparatus fashioned in the form of a small press with an upper and lower anvil. The upper anvil is at rest against a 200-pound die spring, and the lower anvil is movable through 0.300 inch by means of a crank mechanism. In its open position, the gap between the anvils is 1.780 inches, allowing a clearance of 0.200 inch for insertion of the ball. As the lower anvil is raised by the crank, it compresses the ball against the upper anvil, such compression occurring during the last 0.200 inch of stroke of the lower anvil, the ball then loading the upper anvil which in turn loads the spring. The equilibrium point of the upper anvil is measured by a dial micrometer if the anvil is deflected by the ball more than 0.100 inches (less deflection is simply regarded as zero compression) and the reading on the micrometer dial is referred to as the compression of the ball. In practice, tournament quality balls have compression ratings around 80 to 100 which means that the upper anvil was deflected a total of 0.120 to 0.100 inch. When golf ball components (i.e., centers, cores, mantled core, etc.) smaller than 1.680 inches in diameter are utilized, metallic shims are included to produce the combined diameter of the shims and the component to be 1.680 inches.

An example to determine PGA compression can be shown by utilizing a golf ball compression tester produced by OK Automation, Sinking Spring, Pa. (formerly, Atti Engineering Corporation of Newark, N.J.). The compression tester produced by OK Automation is calibrated against a calibration spring provided by the manufacturer. The value obtained by this tester relates to an arbitrary value expressed by a number which may range from 0 to 100, although a value of 200 can be measured as indicated by two revolutions of the dial indicator on the apparatus. The value obtained defines the deflection that a golf ball undergoes when subjected to compressive loading. The Atti test apparatus consists of a lower movable platform and an upper movable spring-loaded anvil. The dial indicator is mounted such that is measures the upward movement of the spring-loaded anvil. The golf ball to be tested is placed in the lower platform, which is then raised a fixed distance. The upper portion of the golf ball comes in contact with and exerts a pressure on the spring-loaded anvil. Depending upon the distance of the golfball to be compressed, the upper anvil is forced upward against the spring.

Alternative devices have also been employed to determine compression. For example, Applicant also utilizes a modified Riehle Compression Machine originally produced by Riehle Bros. Testing Machine Company, Philadelphia, Pa., to evaluate compression of the various components (i.e., cores, mantle cover balls, finished balls, etc.) of the golf balls. The Riehle compression device determines deformation in thousandths of an inch under a load designed to emulate the 200 pound spring constant of the Atti or PGA compression testers. Using such a device, a Riehle compression of 61 corresponds to a deflection under load of 0.061 inch.

Furthermore, additional compression devices may also be utilized to monitor golf ball compression. These devices have been designed, such as a Whitney Tester, Whitney Systems, Inc., Chelsford, Mass., or an Instron Device, Instron Corporation, Canton, Mass., to correlate or correspond to PGA or Atti compression through a set relationship or formula.

As used herein, "Shore B or Shore D hardness" of a cover or mantle is measured generally in accordance with ASTM D-2240, except the measurements are made on the curved surface of a molded cover, rather than on a plaque. Furthermore, the Shore B or Shore D hardness of the cover or mantle is measured while the cover remains over the core. When a hardness measurement is made on a dimpled cover, Shore B hardness is measured at a land area of the dimpled cover.

A "Mooney unit" is an arbitrary unit used to measure the plasticity of raw, or unvulcanized rubber. The plasticity in Mooney units is equal to the torque, measured on an arbitrary scale, on a disk in a vessel that contains rubber at a temperature of 212° F. (100° C.) and that rotates at two revolutions per minute.

The measurement of Mooney viscosity, i.e. Mooney viscosity [$ML_{1+4}$(100° C.], is defined according to the standard ASTM D-1646, herein incorporated by reference. In ASTM D-1646, it is stated that the Mooney viscosity is not a true viscosity, but a measure of shearing torque over a range of shearing stresses. Measurement of Mooney viscosity is also described in the *Vanderbilt Rubber Handbook*, 13th Ed., (1990), pages 565-566, also herein incorporated by reference. Generally, polybutadiene rubbers have Mooney viscosities, measured at 212° F., of from about 25 to about 65. Instruments for measuring Mooney viscosities are commercially available such as a Monsanto Mooney Viscometer, Model MV 2000. Another commercially available device is a Mooney viscometer made by Shimadzu Seisakusho Ltd.

As will be understood by those skilled in the art, polymers may be characterized according to various definitions of molecular weight. The "number average molecular weight," $M_n$, is defined as:

$$M_n = \frac{\Sigma N_i / M_i}{\Sigma N_i}$$

where the limits on the summation are from i=1 to i=infinity where $N_i$ is the number of molecules having molecular weight $M_i$.

"Weight average molecular weight," $M_w$ is defined as:

$$M_w = \frac{\Sigma N_i M_i^2}{\Sigma N_i M_i}$$

where $N_i$ and $M_i$ have the same meanings as noted above. The "Z-average molecular weight," $M_z$, is defined as:

$$M_z = \frac{\Sigma N_i M_i^{a+1}}{\Sigma N_i M_i^a}$$

where $N_i$ and $M_i$ have the same meanings as noted above and a=2. $M_z$ is a higher order molecular weight that gives an indication of the processing characteristics of a molten polymer.

"$M_{peak}$" is the molecular weight of the most common fraction or sample, i.e. having the greatest population.

Considering these various measures of molecular weight, provides an indication of the distribution or rather the "spread" of molecular weights of the polymer under review.

A common indicator of the degree of molecular weight distribution of a polymer is its "polydispersity", P:

$$P = \frac{M_w}{M_n}$$

Polydispersity, also referred to as "dispersity", also provides an indication of the extent to which the polymer chains share the same degree of polymerization. If the polydispersity is 1.0, then all polymer chains must have the same degree of polymerization. Since weight average molecular weight is always equal to or greater than the number average molecular weight, polydispersity, by definition, is equal to or greater than 1.0.

As used herein, the term "phr" refers to the number of parts by weight of a particular component in an elastomeric or rubber mixture, relative to 100 parts by weight of the total elastomeric or rubber mixture.

The core of the present disclosure is an elastomeric rubber composition. In embodiments, it is a molded core comprising a polybutadiene composition containing at least one curing agent. Polybutadiene has been found to be particularly useful because it imparts to the golf balls a relatively high COR. Polybutadiene can be cured using a free radical initiator such as a peroxide. A broad range for the Mw of the polybutadiene composition is from about 50,000 to about 1,000,000; a narrower range is from about 50,000 to about 500,000. A high cis-polybutadiene, such as a cis-1-4-polybutadiene, is preferably employed, or a blend of high cis-1-4-polybutadiene with other elastomers may also be utilized. In specific embodiments, a high cis-1-4-polybutadiene having a $M_w$ of from about 100,000 to about 500,000 is employed.

A specific polybutadiene which may be used in the core of certain embodiments of the present disclosure features a cis-1,4 content of at least 90% and preferably greater than 96% such as Cariflex® BR-1220 currently available from Dow Chemical, France; and Taktene® 220 currently available from Bayer, Orange, Tex.

For example, Cariflex® BR-1220 polybutadiene and Taktene® 220 polybutadiene may be utilized alone, in combination with one another, or in combination with other polybutadienes. Generally, these other polybutadienes have Mooney viscosities in the range of about 25 to 65 or higher. The general properties of BR-1220 and Taktene® 220 are set forth below.

A. Properties of Cariflex® BR-1220 Polybutadiene

Physical Properties:

Polybutadiene Rubber

CIS 1,4 Content—97%-99% Min.

Stabilizer Type—Non Staining

Total Ash—0.5% Max.

Specific Gravity—0.90-0.92

Color—Transparent, clear, Lt. Amber

Moisture—0.3% max. ASTM® 1416.76 Hot Mill Method

Polymer Mooney Viscosity—(35-45 Cariflex®) ($ML_{1+4}$ @ 212° F.)

90% Cure—10.0-13.0

Polydispersity 2.5-3.5

| Molecular Weight Data: | Trial 1 | Trial 2 |
|---|---|---|
| $M_n$ | 80,000 | 73,000 |
| $M_w$ | 220,000 | 220,000 |
| $M_z$ | 550,000 | |
| $M_{peak}$ | 110,000 | |

B. Properties of Taktene® 220 Polybutadiene

Physical Properties:

Polybutadiene Rubber

CIS 1,4 Content (%)—98% Typical

Stabilizer Type—Non Staining 1.0-1.3%

Total Ash—0.25 Max.

Raw Polymer Mooney Visc.—35-45 40 Typical ($ML_{+4}$'@212 Deg. F./212° F.)

Specific Gravity—0.91

Color—Transparent—almost colorless (15 APHA Max.)

Moisture %—0.30% Max. ASTM® 1416-76 Hot Mill Method

Product A relatively low to mid Mooney viscosity, non-staining, solution

Description polymerized, high cis-1,4-polybutadiene rubber.

| Raw Polymer | Property | Range | Test Method |
|---|---|---|---|
| Properties | Mooney viscosity | | |
| | $ML_{1+4}$(212° F.) | 40 5 | ASTM ® D 1646 |
| | Volatile matter (wt %) | 0.3 max. | ASTM ® D 1416 |
| | Total Ash (wt %) | 0.25 max. | ASTM ® D 1416 |
| Cure[1][2] Characteristics | | | |
| | Minimum torque | | |
| | $M_L$(dN · m) | 9.7 2.2 | ASTM ® D 2084 |
| | (lbf) · in) | 8.6 1.9 | ASTM ® D 2084 |
| | Maximum torque | | |
| | $M_H$ (dN · m) | 35.7 4.8 | ASTM ® D 2084 |
| | (lbf · in) | 31.6 4.2 | ASTM ® D 2084 |
| | $t_21$ (min) | 4 1.1 | ASTM ® D 2084 |
| | t'50 (min) | 9.6 2.5 | ASTM ® D 2084 |
| | t'90 (min) | 12.9 3.1 | ASTM ® D 2084 |

Other Product Features

| Property | Typical Value |
|---|---|
| Specific gravity | 0.91 |
| Stabilizer type | Non-staining |

[1]Monsanto Rheometer at 160° C., 1.7 Hz (100 cpm), 1 degree arc, micro-die

[2]Cure characteristics determined on ASTM ® D 3189 MIM mixed compound:

| | |
|---|---|
| TAKTENE ® 220 | 100 (parts by mass) |
| Zinc oxide | 3 |
| Stearic acid | 2 |
| IRB #6 black (N330) | 60 |
| Naphthenic oil | 15 |
| TBBS | 0.9 |
| Sulfur | 1.5 |

* This specification refers to product manufactured by Bayer Corp., Orange, Tex., U.S.A.

An example of a high Mooney viscosity polybutadiene suitable for use with the present development includes Cariflex® BCP 820, from Shell Chimie of France. Although this polybutadiene produces cores exhibiting higher COR values, it is somewhat difficult to process using conventional equipment. The properties and characteristics of this preferred polybutadiene are set forth below.

Properties of Shell Chimie BCP 820 (Also Known As BR-1202J)

| Property | Value |
|---|---|
| Mooney Viscosity (approximate) | 70-83 |
| Volatiles Content | 0.5% maximum |
| Ash Content | 0.1% maximum |
| Cis 1,4-polybutadiene Content | 95.0% minimum |
| Stabilizer Content | 0.2 to 0.3% |
| Polydispersity | 2.4-3.1 |

| Molecular Weight Data: | Trial 1 | Trial 2 |
|---|---|---|
| $M_n$ | 110,000 | 111,000 |
| $M_w$ | 300,000 | 304,000 |
| $M_z$ | 680,000 | |
| $M_{peak}$ | 175,000 | |

Examples of further polybutadienes include those obtained by using a neodymium-based catalyst, such as Neo Cis 40 and Neo Cis 60 from Enichem, Polimeri Europa America, 200 West Loop South, Suite 2010, Houston, Tex. 77027, and those obtained by using a neodymium based catalyst, such as CB-22, CB-23, and CB-24 from Bayer Co., Pittsburgh, Pa. The properties of these polybutadienes are given below.

A. Properties of Neo Cis 40 and 60

| Properties of Raw Polymer | |
|---|---|
| Microstructure | |
| 1,4 cis (typical) | 97.5% |
| 1,4 trans (typical) | 1.7% |
| Vinyl (typical) | 0.8% |
| Volatile Matter (max) | 0.75% |
| Ash (max) | 0.30% |
| Stabilizer (typical) | 0.50% |
| Mooney Viscosity, $ML_{1+4}$ at 100° C. | 38-48 and 60-66 |
| Properties of compound (typical) | |
| Vulcanization at 145° C. | |
| Tensile strength, 35' cure, | 16 MPa |
| Elongation, 35' cure, | 440% |
| 300% modulus, 35' cure, | 9.5 MPa |

B. Properties of CB-22

| TESTS | RESULTS | SPECIFICATIONS |
|---|---|---|
| 1. Mooney-Viscosity | | |
| ML1 + 4 100 Cel/ASTM ®-sheet | | |
| ML1 + 1 Minimum | 58 | MIN. 58 ME |
| Maximum | 63 | MAX. 68 ME |
| Median | 60 | 58-68 ME |
| 2. Content of ash | 0.1 | MAX. 0.5% |
| DIN 53568 | | |
| Ash | | |
| 3. Volatile matter | 0.11 | MAX. 0.5% |
| heating 3 h/105 Cel | | |
| Loss in weight | | |
| 4. Organic acid | 0.33 | MAX. 1.0% |
| Bayer Nr. 18 | | |
| Acid | | |
| 5. CIS-1,4 content | 97.62 | MIN. 96.0% |
| IR-spectroscopy | | |
| CIS 1,4 | | |

-continued

| TESTS | RESULTS | SPECIFICATIONS |
|---|---|---|
| 6. Vulcanization behavior | | |
| Monsanto MDR/160 Cel | | |
| DIN 53529 | | |
| Compound after | | |
| ts01 | 3.2 | 2.5-4.1 min |
| t50 | 8.3 | 6.4-9.6 min |
| t90 | 13.2 | 9.2-14.0 min |
| s'min | 4.2 | 3.4-4.4 dN · m |
| s'max | 21.5 | 17.5-21.5 dN · m |
| 7. Informative data | | |
| Vulcanization 150 Cel 30 min | | |
| Tensile | ca. 15.0 | |
| Elongation at break | ca. 450 | |
| Stress at 300% elongation | ca. 9.5 | |

C. Properties of CB-23

| TESTS | RESULTS | SPECIFICATIONS |
|---|---|---|
| 1. Mooney-Viscosity | | |
| ML1 + 4 100 Cel/ASTM ®-sheet | | |
| ML1 + 4 Minimum | 50 | MIN. 46 ME |
| Maximum | 54 | MAX. 56 ME |
| Median | 51 | 46-56 ME |
| 2. Content of ash | 0.09 | MAX. 0.5% |
| DIN 53568 | | |
| Ash | | |
| 3. Volatile matter | 0.19 | MAX. 0.5% |
| DIN 53526 | | |
| Loss in weight | | |
| 4. Organic acid | 0.33 | MAX. 1.0% |
| Bayer Nr. 18 | | |
| Acid | | |
| 5. CIS-1,4 content | 97.09 | MIN. 96.0% |
| IR-spectroscopy | | |
| CIS 1,4 | | |
| 6. Vulcanization behavior | MIN. 96.0 | |
| Monsanto MDR/160 Cel | | |
| DIN 53529 | | |
| Compound after | | |
| ts01 | 3.4 | 2.4-4.0 min |
| t50 | 8.7 | 5.8-9.0 min |
| t90 | 13.5 | 8.7-13.5 min |
| s'min | 3.1 | 2.7-3.8 dN · m |
| s'max | 20.9 | 17.7-21.7 dN · m |
| 7. Vulcanization test | | |
| with ring | | |
| Informative data | | |
| Tensile | ca. 15.5 | |
| Elongation at break | ca. 470 | |
| Stress at 300% elongation | ca. 9.3 | |

D. Properties of CB-24

| TESTS | RESULTS | SPECIFICATIONS |
|---|---|---|
| 1. Mooney-Viscosity | | |
| ML1 + 4 100 Cel/ASTM ®-sheet | | |
| ML1 + 4 Minimum | 44 | MIN. 39 ME |
| Maximum | 46 | MAX. 49 ME |
| Median | 45 | 39-49 ME |
| 2. Content of ash | 0.12 | MAX. 0.5% |
| DIN 53568 | | |
| Ash | | |

-continued

| TESTS | RESULTS | SPECIFICATIONS |
|---|---|---|
| 3. Volatile matter DIN 53526 Loss in weight | 0.1 | MAX. 0.5% |
| 4. Organic acid Bayer Nr. 18 Acid | 0.29 | MAX. 1.0% |
| 5. CIS-1,4 content IR-spectroscopy CIS 1,4 | 96.73 | MIN. 96.0% |
| 6. Vulcanization behavior Monsanto MDR/160 Cel DIN 53529 Compound after masticator | | |
| ts01 | 3.4 | 2.6-4.2 min |
| t50 | 8.0 | 6.2-9.4 min |
| t90 | 12.5 | 9.6-14.4 min |
| s'min | 2.8 | 2.0-3.0 dN · m |
| s'max | 19.2 | 16.3-20.3 dN · m |
| 7. Informative data Vulcanization 150 Cel 30 min | | |
| Tensile | ca 15.0 | |
| Elongation at break | ca. 470 | |
| Stress at 300% elongation | ca. 9.1 | |

Alternative polybutadienes include fairly high Mooney viscosity polybutadienes including the commercially available BUNA® CB series polybutadiene rubbers manufactured by the Bayer Co., Pittsburgh, Pa. The BUNA® CB series polybutadiene rubbers are generally of a relatively high purity and light color. The low gel content of the BUNA® CB series polybutadiene rubbers ensures almost complete solubility in styrene. The BUNA® CB series polybutadiene rubbers have a relatively high cis-1,4 content. Preferably, each BUNA® CB series polybutadiene rubber has a cis-1,4 content of at least 96%. Additionally, each BUNA® CB series polybutadiene rubber exhibits a different solution viscosity, preferably from about 42 mPa·s to about 170 mPa·s, while maintaining a relatively constant solid Mooney viscosity value range, preferably of from about 38 to about 52. The BUNA® CB series polybutadiene rubbers preferably have a vinyl content of less than about 12%, more preferably a vinyl content of about 2%. In this regard, below is a listing of commercially available BUNA® CB series polybutadiene rubbers and the solution viscosity and Mooney viscosity of each BUNA® CB series polybutadiene rubber.

Solution Viscosity and Mooney Viscosity of BUNA® CB Series Polybutadiene Rubbers

| Property | BUNA ® CB 1405 | BUNA ® CB 1406 | BUNA ® CB 1407 | BUNA ® CB 1409 | BUNA ® CB 1410 |
|---|---|---|---|---|---|
| Solution Viscosity mPa · s | 50 +/− 7 | 60 +/− 7 | 70 +/− 10 | 90 +/− 10 | 100 +/− 10 |
| Mooney Viscosity mL 1 + 4 100° C. | 45 +/− 5 | 45 +/− 5 | 45 +/− 5 | 45 +/− 5 | 45 +/− 5 |

| Property | BUNA ® CB 1412 | BUNA ® CB 1414 | BUNA ® CB 1415 | BUNA ® CB 1416 | BUNA ® CB 10 |
|---|---|---|---|---|---|
| Solution Viscosity mPa · s | 120 +/− 10 | 140 +/− 10 | 150 +/− 10 | 160 +/− 10 | 140 +/− 20 |
| Mooney Viscosity mL 1 + 4 100° C. | 45 +/− 5 | 45 +/− 5 | 45 +/− 5 | 45 +/− 5 | 47 +/− 5 |

| PROPERTIES | | | | | | |
|---|---|---|---|---|---|---|
| Property | Test Method | Units | BUNA ® CB 1406 | BUNA ® CB 1407 | BUNA ® CB 1409 | BUNA ® CB 1410 |
| Catalyst | | | Cobalt | Cobalt | Cobalt | Cobalt |
| Cis-1,4 Content | IR Spectroscopy; AN-SAA 0422 | % | ≧96 | ≧96 | ≧96 | ≧96 |
| Volatile Matter | ISO 248/ ASTM D 1416 | % | ≦0.5 | ≦0.5 | ≦0.5 | ≦0.5 |
| Ash Content | ISO 247/ ASTM D 1416 | % | ≦0.1 | ≦0.1 | ≦0.1 | ≦0.1 |
| Mooney Viscosity ML (1 + 4) 100° C. | ISO 289/DIN 53 523/ ASTM D 1646 | MU | 45 ± 5 | 45 ± 5 | 45 ± 5 | 45 ± 5 |
| Solution Viscosity, 5% in styrene | ASTM D 445/ DIN 51 562 | mPa · s | 60 ± 7 | 70 ± 7 | 90 ±10 | 100 ± 10 |
| Styrene insoluble: dry gel | 08-02.08.CB | ppm | ≦100 | ≦100 | ≦100 | ≦100 |
| Color in styrene | ISO 6271/ ASTM D 1209 | APHA | ≦10 | ≦10 | ≦10 | ≦10 |
| Solubility | | | in aliphatic hydrocarbons | in aliphatic hydrocarbons | in aliphatic hydrocarbons | in aliphatic hydrocarbons |
| Total Amount of Stabilizer | AN-SAA 0583 | % | 0.2 | 0.2 | 0.2 | 0.2 |

-continued

| PROPERTIES | | | | | | |
|---|---|---|---|---|---|---|
| Property | Test Method | Units | BUNA ® CB 1412 | BUNA ® CB 1414 | BUNA ® CB 1415 | BUNA ® CB 1416 |
| Catalyst | | | Cobalt | Cobalt | Cobalt | Cobalt |
| Cis-1,4 Content | IR Spectroscopy; AN-SAA 0422 | % | ≧96 | ≧96 | ≧96 | ≧96 |
| Volatile Matter | ISO 248/ ASTM D 1416 | % | ≦0.5 | ≦0.5 | ≦0.5 | ≦0.5 |
| Ash Content | ISO 247/ ASTM D 1416 | % | ≦0.1 | ≦0.1 | ≦0.1 | ≦0.1 |
| Mooney Viscosity ML (1 + 4) 100° C. | ISO 289/DIN 53 523/ ASTM D 1646 | MU | 45 ± 5 | 45 ± 5 | 45 ± 5 | 45 ± 5 |
| Solution Viscosity, 5% in styrene | ASTM D 445/ DIN 51 562 | mPa · s | 120 ± 10 | 140 ± 10 | 150 ± 10 | 160 ± 10 |
| Styrene insoluble: dry gel | 08-02.08.CB | Ppm | ≦100 | ≦100 | ≦100 | ≦100 |
| Color in styrene | ISO 6271/ ASTM D 1209 | APHA | ≦10 | ≦10 | ≦10 | ≦10 |
| Solubility | | | in aliphatic hydrocarbons | in aliphatic hydrocarbons | in aliphatic hydrocarbons | in aliphatic hydrocarbons |
| Total Amount of Stabilizer | AN-SAA 0583 | % | 0.2 | 0.2 | 0.2 | 0.2 |

In addition to the polybutadiene rubbers noted above, BUNA® CB 10 polybutadiene rubber is also very desirous to be included in the composition of the present development. BUNA® CB 10 polybutadiene rubber has a relatively high cis-1,4 content, good resistance to reversion, abrasion and flex cracking, good low temperature flexibility and high resilience. The BUNA® CB 10 polybutadiene rubber preferably has a vinyl content of less than about 12%, more preferably about 2% or less. Listed below is a brief description of the properties of the BUNA® CB 10 polybutadiene rubber.

Properties of BUNA® CB 10 Polybutadiene Rubber

| Raw Material Properties | Value | Unit | Test method |
|---|---|---|---|
| Volatile Matter | ≦0.5 | Wt-% | ISO 248/ASTM D 5668 |
| Mooney viscosity ML(1 + 4) @ 100° C. | 47 ± 5 | MU | ISO 289/ASTM D 1646 |
| Solution viscosity, 5.43 wt % in toluene | 140 ± 20 | mPa · s | ASTM D 445/ISO 3105 (5% in toluene) |
| Cis-1,4 content | ≧96 | wt-% | IR Spectroscopy, AN-SAA 0422 |
| Color, Yellowness Index | ≦10 | | ASTM E 313-98 |
| Cobalt content | ≦5 | ppm | DIN 38 406 E22 |
| Total Stabilizer content | ≧0.15 | wt-% | AN-SAA 0583 |
| Specific Gravity | 0.91 | | |
| Vulcanization Properties (Test formulation from ISO 2476/ ASTM D 3189 (based on IRB 7)) | Value | Unit | Test Method |
| Monsanto Rheometer MDR 2000E, 160" C./30 min./α = ±0.5" C. | | | |
| Torque Minimum (ML) | 3.5 ± 0.7 | dNm | ISO 6502/ASTM D5289 |
| Torque Maximum (MH) | 19.9 ± 2.4 | dNm | ISO 6502/ASTM D5289 |

-continued

| | | | |
|---|---|---|---|
| Scorch Time, $t.s._1$ | 2.9 ± 0.6 | min | ISO 6502/ASTM D5289 |
| Cure Time, $t.c._{50}$ | 8.7 ± 1.7 | min | ISO 6502/ASTM D5289 |
| Cure Time, $t.c._{90}$ | 12.8 ± 2.4 | min | ISO 6502/ASTM D5289 |

The polybutadiene utilized in the present development can also be mixed with other elastomers. These include natural rubbers, polyisoprene rubber, SBR rubber (styrene-butadiene rubber) and others to produce certain desired core properties.

The elastomeric rubber composition also includes a curing agent. The curing agent is the reaction product of a carboxylic acid or acids and an oxide or carbonate of a metal such as zinc, magnesium, barium, calcium, lithium, sodium, potassium, cadmium, lead, tin, and the like. Exemplary unsaturated carboxylic acids are acrylic acid, methacrylic acid, itaconic acid, crotonic acid, sorbic acid, and the like, and mixtures thereof. Usually, the selected acid is either acrylic or methacrylic acid. From about 15 to about 50, and specifically from about 17 to about 35 parts by weight of the carboxylic acid salt, such as zinc diacrylate (ZDA) is included per 100 parts of the elastomer components in the core when a curing agent is included. The unsaturated carboxylic acids and metal salts thereof are generally soluble in the elastomeric base, or are readily dispersible. Examples of such commercially available curing agents include the zinc acrylates and zinc diacrylates available from Sartomer Company, Inc., 502 Thomas Jones Way, Exton, Pa.

A free radical initiator is optionally included in the elastomeric rubber composition; it is any known polymerization initiator (a co-crosslinking agent) which decomposes during the cure cycle. The term "free radical initiator" as used herein refers to a chemical which, when added to the elastomeric blend, promotes crosslinking of the elastomers. The amount of the selected initiator present is dictated only by the requirements of catalytic activity as a polymerization initiator. Suitable initiators include peroxides, persulfates, azo compounds and hydrazides. Peroxides which are readily commercially available are conveniently used in the present development, generally in amounts of from about 0.1 to about 10.0 and preferably in amounts of from about 0.3 to about 3.0 parts by weight per each 100 parts of elastomer, wherein the peroxide has a 40% level of active peroxide. Crosslinking can be accomplished by using a single peroxide or by combining two or more peroxides. Preferably peroxides having different half lives or decomposition temperatures are used in blends of two or more initiators.

Exemplary of suitable peroxides are dicumyl peroxide, n-butyl 4,4'-bis (butylperoxy) valerate, 1,1-bis(t-butylperoxy)-3,3,5-trimethyl cyclohexane, di-t-butyl peroxide and 2,5-di-(t-butylperoxy)-2,5 dimethyl hexane and the like, as well as mixtures thereof. It will be understood that the total amount of initiators used will vary depending on the specific end product desired and the particular initiators employed.

Examples of such commercial available peroxides are Luperco™ 230 or 231 XL, a peroxyketal manufactured and sold by Atochem, Lucidol Division, Buffalo, N.Y., and Trigonox™ 17/40 or 29/40, a peroxyketal manufactured and sold by Akzo Chemie America, Chicago, Ill. The one hour half life of Luperco™ 231 XL and Trigonox™ 29/40 is about 112° C., and the one hour half life of Luperco™ 230 XL and Trigonox™ 17/40 is about 129° C. Luperco™ 230 XL and Trigonox™ 17/40 are n-butyl-4,4-bis(t-butylperoxy) valerate and Luperco™ 231 XL and Trigonox™ 29/40 are 1,1-di(t-butylperoxy) 3,3,5-trimethyl cyclohexane. Trigonox™ 42-40B is tert-Butyl peroxy-3,5,5-trimethylhexanoate and is available from Akzo Nobel; the liquid form of this agent is available from Akzo under the designation Trigonox™ 42S.

Preferred co-agents which can be used with the above peroxide polymerization agents include zinc diacrylate (ZDA), zinc dimethacrylate (ZDMA), trimethylol propane triacrylate, and trimethylol propane trimethacrylate, most preferably zinc diacrylate. Other co-agents may also be employed and are known in the art.

In further embodiments, the molded core includes a difunctional acrylate. It serves the dual function of being a curing agent and a co-agent to the free radical initiator. In specific embodiments, the molded core includes zinc diacrylate.

The elastomeric polybutadiene compositions of the present development can also optionally include one or more halogenated organic sulfur compounds which serve as a peptizer. The peptizer is usually a halogenated thiophenol of the formula below:

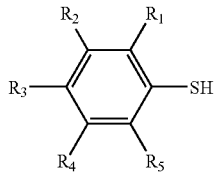

wherein $R_1$-$R_5$ are independently halogen, hydrogen, alkyl, thiol, or carboxylated groups. At least one halogen group is included, preferably 3-5 of the same halogenated groups are included, and most preferably 5 of the same halogenated groups are part of the compound. Examples of such fluoro-, chloro-, bromo-, and iodo-thiophenols include, but are not limited to pentafluorothiophenol; 2-fluorothiophenol; 3-fluorothiophenol; 4-fluorothiophenol; 2,3-fluorothiophenol; 2,4-fluorothiophenol; 3,4-fluorothiophenol; 3,5-fluorothiophenol; 2,3,4-fluorothiophenol; 3,4,5-fluorothiophenol; 2,3,4,5-tetrafluorothiophenol; 2,3,5,6-tetrafluorothiophenol; 4-chlorotetrafluorothiophenol; pentachlorothiophenol; 2-chlorothiophenol; 3-chlorothiophenol; 4-chlorothiophenol; 2,3-chlorothiophenol; 2,4-chlorothiophenol; 3,4-chlorothiophenol; 3,5-chlorothiophenol; 2,3,4-chlorothiophenol; 3,4,5-chlorothiophenol; 2,3,4,5-tetrachlorothiophenol; 2,3,5,6-tetrachlorothiophenol; pentabromothiophenol; 2-bromothiophenol; 3-bromothiophenol; 4-bromothiophehol; 2,3-bromothiophenol; 2,4-bromothiophenol; 3,4-bromothiophenol; 3,5-bromothiophenol; 2,3,4-bromothiophenol; 3,4,5-bromothiophenol; 2,3,4,5-tetrabromothiophenol; 2,3,5,6-tetrabromothiophenol; pentaiodothiophenol; 2-iodothiophenol; 3-iodothiophenol; 4-iodothiophenol; 2,3-iodothiophenol; 2,4-iodothiophenol; 3,4-iodothiophenol; 3,5-iodothiophenol; 2,4-iodothiophenol; 3,4-iodothiophenol; 3,5-iodothiophenol; 2,3,4-iodothiophenol; 3,4,5-iodothiophenol; 2,3,4,5-tetraiodothiophenol; 2,3,5,6-tetraiodothiophenol; and their metal salts thereof, and mixtures thereof. The metal salt may be salts of zinc, calcium, potassium, magnesium, sodium, and lithium.

In a specific embodiment, pentachlorothiophenol or zinc pentachlorothiophenol is included in the elastomeric composition. For example, RD 1302 of Rheim Chemie of Trenton, N.J. can be included therein. RD 1302 is a 75% masterbatch of Zn PCTP in a high-cis polybutadiene rubber.

Other suitable pentachlorothiphenols include those available from Dannier Chemical, Inc., Tustin, Calif., under the designation DansofP™. The product specifications of DansofP™ are set forth below:

| | |
|---|---|
| Compound Name | Pentachlorothiophenol |
| Synonym | (PCTP) |
| CAS # | n/a |
| Molecular Formula: | C6CI5SH |
| Molecular Weight: | 282.4 |
| Grade: | Dansof P |
| Purity: | 97.0% (by HLPC) |
| Physical State: | Free Flowing Powder |
| Appearance | Light Yellow to Gray |
| Moisture Content (K.F.) | <0.4% |
| Loss on Drying (% by Wt.): | <0.4% |
| Particle Size: | 80 mesh |

A representative metallic salt of pentachlorothiophenol is the zinc salt of pentachlorothiophenol (ZnPCTP) sold by Dannier Chemical, Inc. under the designation DansofZ™. The properties of this material are as follows:

| | |
|---|---|
| Compound Name | Zinc Salt of Pentachlorothiophenol |
| Synonym | Zn(PCTP) |
| CAS # | n/a |
| Molecular Formula: | |
| Molecular Weight: | |
| Grade: | DR 14 |
| Purity: | =99.0% |
| Physical State: | Free Flowing Powder |
| Appearance | Off-white/Gray |
| Odor: | Odorless |
| Moisture Content (K.F.) | <0.5% |
| Loss on Drying (% by Wt.): | <0.5% |
| Mesh Size: | 100 |
| Specific Gravity | 2.33 |

The pentachlorothiophenol or metallic salt thereof is added in an amount of 0.01 to 5.0 parts by weight, preferably 0.1 to 2.0 parts by weight, more preferably 0.2 to 1.0 parts by weight, on the basis of 100 parts by weight of the elastomer.

The elastomeric rubber composition may further comprise a thiosynergist, such as a metal thiosulfate. In specific embodiments, the metal thiosulfate is disodium hexamethylene thiosulfate dihydrate (DHTS). In other specific embodiments, both DHTS and a halogenated thiophenol are included in the elastomeric rubber composition; the combination produces synergistic effects which results in enhanced compression and/or resilience in the molded core over known compositions. The combination can also be utilized in combination with lower solution viscosity and/or lower linearity (more branched) polybutadiene materials and crosslinking agents to produce similar compression (i.e., softness) and/or resilience characteristics produced by components molded from high solution viscosity/high linearity polymer polybutadienes. This allows for the interchangeability of these materials for certain usages in golf ball construction. This is both a cost and processing advantage in that the high solution/high linearity polymers are more expensive to make and do not process as well due to their "sticky" nature. The amount of the thiosynergist such as DHTS is preferably from about 0.1 to about 3.0 parts by weight, more preferably from about 0.5 to about 2.0 parts by weight, and most preferably from about 0.5 to about 1.5 parts by weight, on the basis of 100 parts by weight of the elastomer.

In addition to the foregoing, filler materials can be employed in the compositions of the development to control the weight and density of the ball. Fillers which are incorporated into the compositions should be in finely divided form, typically in a size generally less than about 20 mesh, preferably less than about 100 mesh U.S. standard size. Preferably, the filler is one with a specific gravity of from about 0.5 to about 19.0. Examples of fillers which may be employed include, for example, silica, clay, talc, mica, asbestos, glass, glass fibers, barytes (barium sulfate), limestone, lithophone (zinc sulphide-barium sulfate), zinc oxide, titanium dioxide, zinc sulphide, calcium metasilicate, silicon carbide, diatomaceous earth, particulate carbonaceous materials, micro balloons, aramid fibers, particulate synthetic plastics such as high molecular weight polyethylene, polystyrene, polyethylene, polypropylene, ionomer resins and the like, as well as cotton flock, cellulose flock and leather fiber. Powdered metals such as titanium, tungsten, aluminum, bismuth, nickel, molybdenum, copper, brass and their alloys also may be used as fillers.

The amount of filler employed is primarily a function of weight restrictions on the weight of a golf ball made from those compositions. In this regard, the amount and type of filler will be determined by the characteristics of the golf ball desired and the amount and weight of the other ingredients in the core composition. The overall objective is to closely approach the maximum golf ball weight of 1.620 ounces (45.92 grams) set forth by the U.S.G.A.

The compositions of the development also may include various processing aids known in the rubber and molding arts, such as fatty acids. Generally, free fatty acids having from about 10 carbon atoms to about 40 carbon atoms, preferably having from about 15 carbon atoms to about 20 carbon atoms, may be used. Fatty acids which may be used include stearic acid and linoleic acids, as well as mixtures thereof. When included in the compositions of the development, the fatty acid component is present in amounts of from about 1 part by weight per 100 parts elastomer, preferably in amounts of from about 2 parts by weight per 100 parts elastomer to about 5 parts by weight per 100 parts elastomer. Examples of processing aids which may be employed include, for example, calcium stearate, barium stearate, zinc stearate, lead stearate, basic lead stearate, dibasic lead phosphite, dibutyltin dilaurate, dibutyltin dimealeate, dibutyltin mercaptide, as well as dioctyltin and stannane diol derivatives.

Furthermore, other additives known to those skilled in the art can also be included in the core components of the embodiments disclosed herein. These additions are included in amounts sufficient to produce the desired characteristics.

The core may be made by conventional mixing and compounding procedures used in the rubber industry. For example, the ingredients may be intimately mixed using, for example, two roll mills or a BANBURY® mixer, until the composition is uniform, usually over a period of from about 5 to 20 minutes. The sequence of addition of components is not critical. One blending sequence is as follows.

The elastomer, DHTS, zinc pentachlorothiophenol, and other components comprising the elastomeric rubber composition are blended for about 7 minutes in an internal mixer such as a BANBURY® mixer. As a result of shear during mixing, the temperature rises to about 200° F. The initiator and diisocyanate are then added and the mixing continued until the temperature reaches about 220° F. whereupon the batch is discharged onto a two roll mill, mixed for about one minute and sheeted out. The mixing is desirably conducted in such a manner that the composition does not reach incipient polymerization temperature during the blending of the various components.

The composition can be formed into a core by any one of a variety of molding techniques, e.g. injection, compression, or transfer molding. If the core is compression molded, the sheet is then rolled into a "pig" and then placed in a BARWELL™ preformer and slugs are produced. The slugs are then subjected to compression molding at about 320° F. for about 14 minutes. After molding, the molded cores are cooled at room temperature for about 4 hours or in cold water for about one hour.

Usually the curable component of the composition will be cured by heating the composition at elevated temperatures on the order of from about 275° F. to about 350° F., preferably and usually from about 290° F. to about 325° F., with molding of the composition effected simultaneously with the curing thereof. When the composition is cured by heating, the time required for heating will normally be short, generally from about 10 to about 20 minutes, depending upon the particular curing agent used. Those of ordinary skill in the art relating to free radical curing agents for polymers are conversant with adjustments to cure times and temperatures required to effect optimum results with any specific free radical agent.

After molding, the core is removed from the mold and the surface may be treated to facilitate adhesion thereof to the covering materials. Surface treatment can be effected by any of the several techniques known in the art, such as corona discharge, ozone treatment, sand blasting, centerless grinding, and the like. Alternatively, the cores are used in the as-molded state with no surface treatment.

The resulting core generally has a diameter of about 1.0 to 2.0 inches, preferably about 1.40 to 1.60 inches, and more preferably from about 1.470 to about 1.585 inches. Additionally, the weight of the core is adjusted so that the finished golf ball closely approaches the U.S.G.A. upper weight limit of 1.620 ounces. It has the high resiliency and softness (i.e., low compression) desired. The molded core exhibits a COR of greater than 0.760, preferably greater than 0.780, and more preferably greater than 0.800, and a compression (Instron) of greater than 0.0880, preferably greater than 0.0900, and more preferably greater than 0.0950.

In an exemplary embodiment of the invention comprising one or more inner layers or mantle layers, the inner mantle comprises an ionomeric resin. Ionomeric resins are polymers containing interchain ionic bonding. They are generally ionic copolymers of an olefin, such as ethylene, and a metal salt of an unsaturated carboxylic acid, such as acrylic acid, methacrylic acid, or maleic acid. Metal ions, such as sodium or zinc, are used to neutralize some portion of the acidic group in the copolymer resulting in a thermoplastic elastomer exhibiting enhanced properties, such as increased durability and hardness. There are many commercial grades of ionomers available both from DuPont and Exxon, with a wide range of properties which vary according to the type and amount of metal cations, molecular weight, composition of the base resin (such as relative content of ethylene and methacrylic and/or acrylic acid groups) and additive ingredients such as reinforcement agents, and the like.

In one exemplary embodiment, the inner mantle comprises a highly neutralized ionomer. The ionomer is neutralized to 80% or greater and sometimes to 90% or greater. In more specific embodiments, the ionomer has been neutralized to almost 100%.

The ionomer may also be modified with a fatty acid or a salt thereof. Generally, they comprise fatty acids neutralized with metal ions. The fatty acids can be saturated or unsaturated fatty acids, and are preferably saturated fatty acids. The fatty acids are generally composed of a chain of alkyl groups containing from about 2 to about 80 carbon atoms, preferably from about 4 to about 30, usually an even number, and having a terminal carboxyl (—COOH) group. The general formula for fatty acids, except for acetic acid, is $CH_3(CH_2)_XCOOH$, wherein the carbon atom count includes the carboxyl group, and x is from about 4 to about 30. Examples of fatty acids suitable for use include, but are not limited to, stearic acid; oleic acid; palmitic acid; pelargonic acid; lauric acid; butryic acid; valeric acid; caproic acid; caprylic acid; capric acid; myristic acid; margaric acid; arachidic acid; behenic acid; lignoceric acid; cerotic acid; carboceric acid; montanic acid; and melissic acid. The fatty acids are preferably neutralized with metal ions such as zinc, calcium, magnesium, barium, sodium, lithium, and aluminum, as well as mixtures of the metal ions, although other metals may also be used. The metal ions are generally metal salts that provide metal ions capable of neutralizing, to various extents, the carboxylic acid groups of the fatty acids. Examples include the sulfate, carbonate, acetate and hydroxylate salts of metals such as zinc, calcium, magnesium and barium. Examples of the fatty acid salts that may be utilized herein include, but are not limited to metal stearates, laureates, oleates, palmitates, pelargonates, and the like, such as zinc stearate, calcium stearate, magnesium stearate, barium stearate, and the like. Metal stearates are known in the art and are commercially available from various manufacturers. In embodiments, the ionomer has been modified with stearic acid, oleic acid, a metal stearate, or a metal oleate.

A suitable ionomer is a copolymer of an alpha-olefin and an alpha, beta-unsaturated carboxylic acid (hereinafter an "acid copolymer" and referred to as "EX"). The acid copolymer may contain anywhere from 1 to 30 percent by weight acid. A high acid copolymer containing greater than 16% by weight acid, preferably from about 17 to about 25 weight percent acid, and more preferably about 20 weight percent acid, or a low acid copolymer containing 16% by weight or less acid may be used as desired. The acid copolymer is neutralized with a metal cation salt capable of ionizing or neutralizing the copolymer to the extent desired, generally from about 80% to 100%, usually from 90% to 100%, and sometimes to almost 100%. In specific embodiments, the acid copolymer is neutralized 80% and greater. The amount of metal cation salt needed is that which has enough metal to neutralize up to 100% of the acid groups as desired.

The acid copolymer is preferably made up of from about 10 to about 30% by weight of an alpha, beta-unsaturated carboxylic acid and an alpha-olefin. Optionally, a softening comonomer can be included in the copolymer. Generally, the alpha-olefin has from 2 to 10 carbon atoms and is preferably ethylene, and the unsaturated carboxylic acid is a carboxylic acid having from about 3 to 8 carbons. Examples of such acids include, but are not limited to, acrylic acid, methacrylic acid, ethacrylic acid, chloroacrylic acid, crotonic acid, maleic acid, fumaric acid, and itaconic acid. The carboxylic acid of the acid copolymer is, in embodiments, acrylic acid or methacrylic acid.

A softening comonomer can be optionally included in the acid copolymer. It may be selected from the group consisting of vinyl esters of aliphatic carboxylic acids wherein the acids have 2 to 10 carbon atoms and vinyl ethers wherein the alkyl groups contain 1 to 10 carbon atoms.

Consequently, examples of acid copolymers include, but are not limited to, an ethylene/acrylic acid copolymer, an ethylene/methacrylic acid copolymer, an ethylene/itaconic acid copolymer, an ethylene/maleic acid copolymer, an ethylene/methacrylic acid/vinyl acetate copolymer, an ethylene/acrylic acid/vinyl alcohol copolymer, and the like. The acid copolymer broadly contains 1 to about 30% by weight unsaturated carboxylic acid, from about 70 to about 99% by weight ethylene and from 0 to about 40% by weight of a softening comonomer.

Acid copolymers are well known in the golf ball art. Examples of acid copolymers which fulfill the criteria set forth above include, but are not limited, to the Escor™ ethylene-acrylic acid copolymers and Iotek acid terpolymers (ethylene-acrylic acid-acrylate terpolymers) sold by Exxon Mobile Corporation, such as Escor™ 959, Escor™ 960, AT325 and Iotek™ 7510, and the Primacor™ ethylene-acrylic acid copolymers sold by Dow Chemical Company, Midland, Mich., such as Primacor™ 5980I and Primacor™ 3340I. Other acid copolymers that may be used include ethylene-methacrylic acid copolymers such as Surlyn™ and Nucrel™ available from E. I. DuPont de Nemours & Co. Surlyn™ ionomers are ethylene-methacrylic acid copolymers neutralized with zinc, sodium, magnesium or lithium ions. Nucrel™ is an ethylene copolymer which is inherently flexible like EVA copolymers, and which offers desirable performance characteristics similar to those of Surlyn™ ionomers. The Nucrel™ acid copolymers are produced by reacting ethylene and methacrylic acid in the presence of free radical initiators. A branched, random ethylene methacrylic acid (EMAA) copolymer is produced thereby. Carboxyl groups are distributed along the chain and interact with carboxyl groups on adjacent molecules to form a weakly cross-linked network through hydrogen bonding. Nucrel™ and Surlyn™ terpolymers are also available.

The acid copolymers are neutralized to a desired percentage through the use of metal cation salts. The metal cation salts utilized are those salts that provide the metal cations capable of neutralizing, to various extents, the carboxylic acid groups of the acid copolymer. These include, for example, acetate, oxide or hydroxide salts of lithium, calcium, zinc, sodium, potassium, nickel, magnesium, aluminum, zirconium, and manganese.

Some examples of such lithium ion sources are lithium hydroxide monohydrate, lithium hydroxide, lithium oxide and lithium acetate. Sources for the calcium ion include calcium hydroxide, calcium acetate and calcium oxide. Suitable zinc ion sources are zinc acetate dihydrate and zinc acetate, a blend of zinc oxide and acetic acid. Examples of sodium ion sources are sodium hydroxide and sodium acetate. Sources for the potassium ion include potassium hydroxide and potassium acetate. Suitable nickel ion sources are nickel acetate, nickel oxide and nickel hydroxide. Sources of magnesium include magnesium oxide, magnesium hydroxide, and magnesium acetate. Sources of manganese include manganese acetate and manganese oxide.

Additionally a wide variety of pre-neutralized acid copolymers are commercially available. These include both hard and soft pre-neutralized ionomer resins and both low and high acid pre-neutralized ionomer resins.

The hard (high modulus) pre-neutralized ionomers include those ionomers having a hardness greater than 50 on the Shore D scale as measured in accordance with ASTM method D-2240, and a flexural modulus from about 15,000 to about 70,000 psi as measured in accordance with AS™ method D-790.

Pre-neutralized soft ionomer resins can also be used in the present disclosure. The soft (low modulus) pre-neutralized ionomers are generally acrylic acid or methacrylic acid based soft ionomers. One example of a soft pre-neutralized ionomer is a zinc based ionomer made from an acrylic acid base polymer and an unsaturated monomer of the acrylate ester class. The soft (low modulus) ionomers generally have a hardness from about 20 to about 50 (preferably from about 30 to about 40) as measured on the Shore D scale and a flexural modulus from about 2,000 to about 15,000 psi (preferably from about 3,000 to 10,000 psi) as measured in accordance with ASTM method D-790. Examples of hard and soft ionomers include those Iotek™ ionomers and Surlyn™ ionomers known in the art.

Another suitable ionomer is a copolymer of an alpha-olefin and a metallocene-catalyzed ethylene alpha-olefin copolymer (hereinafter a "metallocene copolymer" and referred to as "EM"). The metallocene-catalyzed ethylene alpha-olefin copolymer alone may also be referred to as a plastomer.

The metallocene-catalyzed ethylene alpha-olefin copolymers, or plastomers, are ethylene alpha-olefin copolymers wherein the alpha-olefin preferably has from 4 to 8 carbon atoms. The plastomers employed are polyolefin copolymers developed using metallocene single-site catalyst technology. Polyethylene plastomers generally have better impact resistance than polyethylenes made with Ziegler-Natta catalysts. Plastomers exhibit both thermoplastic and elastomeric characteristics. In addition to being comprised of a polyolefin such as ethylene, plastomers contain up to about 35 weight percent comonomer. Plastomers include but are not limited to ethylene-butene copolymers, ethylene-octene copolymers, ethylene-hexene copolymers, and ethylene-hexene-butene terpolymers, as well as mixtures thereof.

The plastomers may be formed by a single site metallocene catalyst such as those disclosed in European Patent Number 29368, U.S. Pat. Nos. 4,752,597, 4,808,561, and 4,937,299, the teachings of which are incorporated herein by reference. Blends of plastomers can be used. As is known in the art, plastomers can be produced by solution, slurry and gas phase accesses (processes?)but the preferred materials are produced by metallocene catalysis using a high pressure process by polymerizing ethylene in combination with other olefin monomers, such as butene-1, hexene-1, octene-1 and 4-methyl-1-pentene in the presence of catalyst system comprising a cyclopentadienyl-transition metal compound and an alumoxane.

Examples of plastomers that may be used are those commercially available from ExxonMobil Chemical under the trademark "EXACT" and include linear ethylene-butene copolymers such as EXACT 3024; EXACT 3025; and EXACT 3027. Other useful plastomers include but are not limited to ethylene-hexene copolymers such as EXACT 3031, as well as EXACT 4049, which is an ethylene-butene copolymer. EXACT plastomers typically have a polydispersity of about 1.5 to 4.0, a density of about 0.86 to about 0.93 g/cc, a melting point of about 140-220° F., and a melt index (MI) above about 0.5 g/10 mins. Plastomers which may be employed in the disclosure include copolymers of ethylene and at least one C3 to C20 alpha-olefin, preferably a C4 to C8 alpha-olefin present in an amount of about 5 to about 32 weight percent. These plastomers are believed to have a composition distribution breadth index of about 45% or more.

Plastomers such as those sold by Dow Chemical Co. under the trade name ENGAGE may also be used. These plastomers are believed to be produced in accordance with U.S. Pat. No. 5,272,236, the teachings of which are incorporated herein by reference. These plastomers are substantially linear polymers having a density of about 0.85 g/cc to about 0.93 g/cc measured in accordance with ASTM D-792, a melt index (MI) of less than 30 g/10 minutes, and a polydispersity which preferably is less than 5. These plastomers include homopolymers of C2 to C20 olefins such as ethylene, propylene, 4-methyl-1-pentene, and the like, or they can be interpolymers of ethylene with at least one C3 to C20 alpha-olefin and/or C2 to C20 acetylenically unsaturated monomer and/or C4 to C18 diolefins. These plastomers have a polymer backbone that is either unsubstituted or substituted with up to 3 long chain branches/1000 carbons. As used herein, long chain branching means a chain length of at least about 6 carbons, above which the length cannot be distinguished using 13C nuclear magnetic resonance spectroscopy. The preferred ENGAGE plastomers are characterized by a saturated ethylene-octene backbone and a narrow polydispersity of about 2.

Another suitable ionomer is a copolymer of an alpha-olefin and an alkyl acrylate (hereinafter an "alkyl acrylate copolymer" and referred to as "EY"). In embodiments, the alpha-olefin is ethylene and the alkyl acrylate is an ethylene acrylate.

Generally, the ethylene alkyl acrylate copolymers used herein include the copolymers of ethylene and acrylic or methacrylic esters of linear, branched or cyclic alkanols. Preferably, the copolymers contain from about 1 to about 35 weight percent alkyl acrylate and from about 99 to about 65 weight percent ethylene.

Examples of ethylene alkyl acrylate copolymers which may be used include, among others, ethylene-ethyl acrylate (EEA), ethylene-methyl acrylate (EMA), and ethylene-butyl acrylate (EBA) copolymers.

Ethylene-ethyl acrylate (EEA) copolymers are made by the polymerization of ethylene units with randomly distributed ethylene acrylate (EA) comonomer groups. The (EEA) copolymers contain up to about 30% by weight of ethylene acrylate. They are tough, flexible products having a relatively high molecular weight. They have good flexural fatigue and low temperature properties (down to −65° C.). In addition, EEA resists environmental stress cracking as well as ultraviolet radiation. Examples of ethylene-ethyl acrylates, which may be utilized, include Bakelite™ ethylene-ethyl acrylates available from Union Carbide.

EEA is similar to ethylene vinyl acetate (EVA) in its density-property relationships and high-temperature resistance. In addition, like EVA, EEA is not resistant to aliphatic and aromatic hydrocarbons.

Ethylene-methyl acrylate (EMA) copolymers contain up to about 30% by weight of methyl acrylate and yield blown films having rubberlike limpness and high impact strength. These copolymers may be useful in coating and laminating applications as a result of their good adhesion to commonly used substrates. EMAs have good heat-seal characteristics.

Ethylene-methyl acrylate copolymers are manufactured by reacting, at high temperatures and pressures, methyl-acrylate monomers with ethylene and free radical initiators. Polymerization occurs such that the methyl acrylate forms random pendant groups on the polyethylene backbone. The acrylic functionality decreases resin crystallinity and increases polarity to enhance resin properties. The properties depend on molecular weight (determined by melt index) and percent crystallinity. Percent crystallinity is determined by comonomer incorporation. As the comonomer content increases, the film becomes softer; tougher, and easier to heat seal.

EMA films have low modulus (generally less than 10,000 psi), low melting points, and good impact strength. In addition, the EMA resins are highly polar, and as a result are compatible with olefinic and other polymers. They adhere well to many substrates including LDPE, LLDPE, and EVA.

Examples of EMA include the Optema™ or Escor™ EMA copolymer resins available from ExxonMobil Chemical Company. The Optema™ and Escor™ EMA resins are thermally stable ethylene methyl acrylate resins which will accept up to 65% or more fillers and pigments without losing their properties. They are more thermally stable than EVAs and can be extruded or molded over a range of 275-625° F. (compared to an EVA limit of 450° F.) EMAs are generally not corrosive when compared to EVAs, EAAs and ionomers Ethylene butyl acrylates (EBA) can also be included in the disclosure. These are generally similar to EMA, but with improved low temperature impact strength and high clarity. An example is Chevron Chemical Company's ethylene-butyl acrylate copolymer, EBAC™, which is stable at high temperatures, and may be processed as high as 600° F.

Examples of cation salts that may be used to neutralize the ethylene alkyl copolymers are those salts which provide the metal cations capable of hydrolyzing and neutralizing, to various extents, the carboxylic acid esters groups of the ethylene alkyl copolymers. This converts the alkyl ester into a metal salt of the acid. These metal cation salts include, but are not limited to, oxide, carbonate or hydroxide salts of alkali metals such as lithium, sodium and potassium or mixtures thereof.

Some examples include, but are not limited to, lithium hydroxide monohydrate, lithium hydroxide, lithium carbonate, lithium oxide, sodium hydroxide, sodium oxide, sodium carbonate, potassium hydroxide, potassium oxide and potassium carbonate.

The amount of metal cation salt (preferably an alkali metal cation salt) reacted with the ethylene alkyl acrylate copolymer varies depending upon such factors as the reactivity of the salt and the copolymer used, reaction conditions (such as temperature, pressure, moisture content, and the like) and the desired level of conversion. Preferably, the conversion reaction occurs through saponification wherein the carboxylic acid esters of the ethylene alkyl acrylate copolymer are converted by alkaline hydrolysis to form the salt of the acid and alcohol. Examples of such saponification reactions are set forth in U.S. Pat. Nos. 3,970,626, 4,638,034 and 5,218,057 and are incorporated herein by reference.

The products of the conversion reaction are an alkanol (the alkyl group of which comes from the alkyl acrylate comonomer) and a terpolymer of ethylene, alkyl acrylate, and an alkali metal salt of the (meth) acrylic acid. The degree of conversion or saponification is variable depending on the amount of alkali metal cation salt used and the saponification conditions. Generally from about 10% to about 60% of the ester groups are converted during the saponification reaction. The alkanol and other by products can be removed by normal separation processes leaving the remaining metal cation neutralized (or hydrolyzed) ester-based ionomer resin reaction product.

Alternatively, the ethylene alkyl acrylate copolymer can be commercially obtained in a pre-neutralized or saponified condition. For example, a number of metal cation neutralized ester-based ionomer resins produced under the saponification process of U.S. Pat. No. 5,218,057 are available from the Chevron Chemical Company.

Additional examples of the preferred copolymers which fulfill the criteria set forth above, are a series of acrylate copolymers which are commercially available from ExxonMobil Corporation, such as Optema™ ethylene methyl acrylates and Enable™ ethylene butyl acrylates; Elvaloy™ ethylene butyl acrylates available from E.I. DuPont de Nemours & Company, and Lotryl™ ethylene butyl acrylic esters available from Atofina Chemical.

The acrylate ester is preferably an unsaturated monomer having from 1 to 21 carbon atoms which serves as a softening comonomer. The acrylate ester preferably is methyl, ethyl, n-propyl, n-butyl, n-octyl, 2-ethylhexyl, or 2-methoxyethyl 1-acrylate, and most preferably is methyl acrylate or n-butyl acrylate. Another suitable type of softening comonomer is an alkyl vinyl ether selected from the group consisting of n-butyl, n-hexyl, 2-ethylhexyl, and 2-methoxyethyl vinyl ethers.

The acrylate ester-containing ionic copolymer or copolymers used in the golfball component can be obtained by neutralizing commercially available acrylate ester-containing acid copolymers such as polyethylene-methyl acrylate-acrylic acid terpolymers, commercially available from ExxonMobil Corporation as Escor™ ATX or poly (ethylene-butyl acrylate-methacrylic acid) terpolymers, commercially available from E.I. DuPont de Nemours & Company as Nucrel™. The acid groups of these materials and blends are neutralized with one or more of various cation salts including zinc, sodium, magnesium, lithium, potassium, calcium, manganese, nickel, and the like. The degree of neutralization ranges from 10 to about 100%, preferably from about 30 to about 100%, and more preferably from about 40 to about 90%. Generally, a higher degree of neutralization results in a harder and tougher cover material.

The inner mantle may have a starting material which is either a copolymer or a terpolymer. In a specific embodiment, the inner mantle comprises a copolymer of ethylene and ethylene acrylate. In another embodiment, the inner mantle comprises a copolymer of ethylene and either acrylic or methacrylic acid. In another specific embodiment, the inner mantle comprises a terpolymer of ethylene, ethylene acrylate, and methyl acrylate (a softening comonomer). The inner mantle may also comprise blends of copolymers.

Highly neutralized blends of copolymers comprising the inner mantle can be produced by reacting the two copolymers with various amounts of the metal cation salts at a temperature above the crystalline melting point of the copolymer, such as a temperature from about 200° F. to about 500° F., preferably from about 250° F. to about 425° F., under high shear conditions at a pressure of from about 100 psi to 10,000 psi. Other well known blending techniques may also be used. The amount of metal cation salt utilized to produce the highly neutralized blend of copolymers is the quantity that provides a sufficient amount of the metal cations to neutralize the desired percentage of the carboxylic acid groups acid copolymer. The copolymers can be blended before or after neutralization, or they can be mixed and neutralized at the same time.

Another suitable ionomer is DuPont™ HPF 1000 polymer. According to DuPont, HPF 1000 is a magnesium neutralized ionomer. The properties of this material are as follows:

| Property | Value | Unit | Test Method |
|---|---|---|---|
| Melt Flow Index | 0.65 | g/10 min | ASTM D1238 |
| Density | 0.96 | g/cc | ASTM D1003 |
| Tensile Strength | 18 | MPa | ASTM D638 |
| Elongation | 430 | % | ASTM D638 |
| Shore D Hardness | 52 | n/a | ASTM D2240D |
| Flex Modulus | 220 | MPa | ASTM D790 |

An additional suitable HPF material is DuPont's HPF 2000. This resin is also a magnesium neutralized material. It has the following general characteristics:

| Resin Property | Typical Value | Test Method |
|---|---|---|
| General | | |
| Cation type | Magnesium | |
| Melt Flow Index, g/10 min | 1.0 | ASTM D1238 (190° C./2.16 kg) |
| Density, g/cc | 0.96 | ASTM D1003 |
| Mechanical | | |
| Tensile Strength, MPa (kpsi) | 13 (1.8) | ASTM D638 |
| Elongation, % | 330 | ASTM D638 |
| Shore D Hardness | 55 | ASTM D2240D |
| Flex Modulus, MPa (kpsi) | 86 (12) | ASTM D790 |
| Thermal | | |
| Vicat Softening Point, ° C. (° F.) | 54 (129) | ASTM D1525 |

The inner mantle may also comprise filler as described above and other additives such as flow additives, colorant, adhesion promoters, or density adjusting fillers.

The various compositions of the inner mantle may be produced according to conventional melt blending procedures. In one embodiment, the copolymers are blended in a Banbury™ type mixer, two-roll mill, or extruder prior to neutralization. After blending, neutralization then occurs in the melt or molten state in the Banbury™ mixer, mill or extruder. The blended composition is then formed into slabs, pellets, and the like, and maintained in such a state until molding is desired. Alternatively, a simple dry blend of the pelletized or granulated copolymers which have previously been neutralized to a desired extent (and colored masterbatch, if desired) may be prepared and fed directly into the injection molding machine where homogenization occurs in the mixing section of the barrel prior to injection into the mold. If necessary, further additives, such as an inorganic filler, may be added and uniformly mixed before initiation of the molding process.

The resulting inner mantle has excellent properties. The inner mantle has a Shore D hardness of from about 30 to about 80, or from about 40 to about 75, and in specific embodiments from about 50 to about 70. The inner mantle has a flex modulus of from about 1 to about 310 Kpsi, or from about 2 to about 100 Kpsi, and in specific embodiments from about 5 to about 75 Kpsi. The inner mantle has a COR of from about 0.500 to about 0.875, or from about 0.650 to about 0.800, and in specific embodiments from about 0.700 to about 0.840. These properties enhance the resulting golf ball by providing for higher ball velocities than are provided by conventional ionomers of the same hardness while maintaining good feel.

The outer mantle or skin comprises any suitable ionomer resin having the characteristics described. Examples of such suitable ionomer resins are commercially available from DuPont under the designation Surlyn® or from Exxon under the designation Iotek®. High acid ionomers exhibiting good higher Shore D hardness are preferred. The outer mantle preferably has a high flex modulus of from about 1 to about 100, or from about 20 to about 80, and in specific embodiments from about 30 to about 70. The flex modulus is measured in accordance to ASTM D-790. The outer mantle preferably provides excellent adhesion between the cover and the inner mantle. The fatty acids present in the highly neutralized ionomer layer, particularly in the absence of a true melt bond, typically do not promote good adhesion to cast or reaction-injection molded polyurethane/polyureas. However, ionomers not containing fatty acids show good adhesion to both other ionomers and polyurethane/polyureas. Therefore, the ionomer outer mantle provides for excellent adhesion between the highly neutralized ionomer inner mantle and the cover. A specific example of an ionomer suitable for the ionomer skin is a blend of Surlyn 8140, Surlyn 9150, and Surlyn 6120. The outer mantle may be subjected to further post-processing such as centerless grinding, treatment with plasma, or treatment with an additional adhesion promoter.

The outer mantle or skin has a thickness of from about 0.005 inch to about 0.200 inch, including from about 0.020 inch to about 0.100 inch and from about 0.025 inch to about 0.065 inch. The Shore D hardness of the outer mantle or skin is from about 30 to about 80, including from about 50 to about 75, when measured on the ball.

It shall also be noted that a further exemplary embodiment of the present invention may comprise an inner mantle or ply comprising one or more ionomers and an outer mantle or skin comprising a highly neutralized ionomer. The ionomer is neutralized to 80% or greater and sometimes to 90% or greater. In more specific embodiments, the ionomer has been neutralized to almost 100%. In this exemplary embodiment the outer mantle or skin may be subjected to further post-processing such as centerless grinding, treatment with plasma, or treatment with an additional adhesion promoter to provide good adhesion to the polyurethane/polyurea cover.

Furthermore, it shall be noted that a further exemplary embodiment of the present invention comprises a single mantle layer or ply comprising a highly neutralized ionomer. The ionomer is neutralized to 80% or greater and sometimes to 90% or greater. In more specific embodiments, the ionomer has been neutralized to almost 100%. In this exemplary embodiment the outer mantle or skin may be subjected to further post-processing such as centerless grinding, treatment with plasma, or treatment with an additional adhesion promoter to provide good adhesion to the polyurethane/polyurea cover.

The outer layer, or cover layer, of the golf ball is a polyurethane/polyurea cover. As used here, the term "polyurethane" means a polyurethane, a polyurea, combinations thereof, and blends thereof. Polyurethanes are polymers which are used to form a broad range of products. They are generally formed by mixing two primary reactants during processing: an isocyanate-containing reactant and a polyol reactant. In some commercially available systems, an amine, which reacts with isocyanate in the same manner as a polyol and is therefore often referred to as a polyol, is also reacted. The isocyanate-containing reactant is typically a polyisocyanate.

A wide range of combinations of polyisocyanates and polyols, as well as other ingredients, are available. Furthermore, the end-use properties of polyurethanes can be controlled by the type of polyurethane utilized, such as whether the material is thermoset (cross linked molecular structure not flowable with heat) or thermoplastic (linear molecular structure flowable with heat).

Cross linking occurs between the isocyanate groups (—NCO) and the polyol's hydroxyl end-groups (—OH). Cross linking will also occur between the amine groups ($—NH_2$) and the isocyanate groups, forming a polyurea. Additionally, the end-use characteristics of polyurethanes can also be controlled by different types of reactive chemicals and processing parameters. For example, catalysts are utilized to control polymerization rates. Depending upon the processing method, reaction rates can be very quick (as in the case for some reaction injection molding systems ("RIM")) or may be on the order of several hours or longer (as in several coating systems such as a cast system). Consequently, a great variety of polyurethanes are suitable for different end-uses. In embodiments, the polyurethane cover is a cast or a RIM cover.

Polyurethanes are typically classified as thermosetting or thermoplastic. A polyurethane becomes irreversibly "set" when a polyurethane prepolymer is crosslinked with a polyfunctional curing agent, such as a polyamine or a polyol. The prepolymer typically is made from polyether or polyester. A prepolymer is typically an isocyanate terminated polymer that is produced by reacting an isocyanate with a moiety that has active hydrogen groups, such as a polyester and/or polyether polyol. The reactive moiety is a hydroxyl group. Diisocyanate prepolymers based on polyether polyols are preferred because of their water resistance. Additionally, in an alternative embodiment, the diisocyanate prepolymer is based on a polybutadiene diol and/or polybutadiene based diisocyanate.

The physical properties of thermoset polyurethanes are controlled substantially by the degree of cross linking and by the hard and soft segment content. Tightly cross linked polyurethanes are fairly rigid and strong. A lower amount of cross linking results in materials that are flexible and resilient. Thermoplastic polyurethanes have some cross linking, but primarily by physical means, such as hydrogen bonding. The crosslinking bonds can be reversibly broken by increasing temperature, such as during molding or extrusion. In this regard, thermoplastic polyurethanes can be injection molded, and extruded as sheet and blow film. They can be used up to about 400 degrees Fahrenheit, and are available in a wide range of hardnesses.

Polyurethane materials may be formed by the reaction of a polyisocyanate, a polyol, and optionally one or more chain extenders. The polyol component includes any suitable polyether- or polyester polyol. Additionally, in an alternative embodiment, the polyol component is polybutadiene diol. The chain extenders include, but are not limited to, diols, triols and amine extenders.

Any suitable polyisocyanate may be used to form a polyurethane. The polyisocyanate is usually selected from the group of diisocyanates including, but not limited to, 4,4'-diphenylmethane diisocyanate ("MDI"); 2,4-toluene diisocyanate ("TDI"); m-xylylene diisocyanate ("XDI"); methylene bis-(4-cyclohexyl isocyanate) ("HMDI"); hexamethylene diisocyanate ("HDI"); naphthalene-1,5,-diisocyanate ("NDI"); 3,3'-dimethyl-4,4'-biphenyl diisocyanate ("TODI"); 1,4-diisocyanate benzene ("PPDI"); phenylene-1,4-diisocyanate; and 2,2,4- or 2,4,4-trimethyl hexamethylene diisocyanate ("TMDI").

Other diisocyanates include, but are not limited to, isophorone diisocyanate ("IPDI"); 1,4-cyclohexyl diisocyanate ("CHDI"); diphenylether-4,4'-diisocyanate; p,p'-diphenyl diisocyanate; lysine diisocyanate ("LDI"); 1,3-bis (isocyanato methyl) cyclohexane; and polymethylene polyphenyl isocyanate ("PMDI"). Additionally, the diisocyanates may be based on polybutadiene.

When the reactant is a polyol, it is typically a polyfunctional alcohol. The polyol can be an alcohol, diol, triol, etc., depending on the number of hydroxyl groups. Also, a blend of polyols and polyamines for reaction with an isocyanate is referred to as a polyol or polyol blend. Although the reaction of an amine with an isocyanate yields a polyurea linkage, the polymer produced from a mixed polyol-polyamine blend may be referred to as a polyurethane. In embodiments, the hydroxyl-functional polyol may have a hydroxyl equivalent weight in the range of 50 to 1500, in further embodiments it has an equivalent weight in the range of 200 to 500. Compounds containing the hydroxyl functional polyol can include polyesters and polyethers. Alternately, the hydroxyl functional polyol is ethylenically saturated. Some saturated polyethers include polymers of propylene oxide or propylene oxide/ethylene oxide; such materials are usually triols or diols with molecular weights between 1000 and 7000. Polyols marketed by the Bayer Corporation, Pittsburgh, Pa., under the trademark DESMOPHEN may also be used or incorporated into the materials disclosed herein. In specific embodiments, the reaction mixture further comprises a polyether polyol or a polyester polyol. In alternative embodiments, the polyol is based on polybutadiene.

A chain extender lengthens the main chain of polyurethane/polyurea, causing end-to-end attachments. Examples of chain extenders include polyglycols and polyamines. Polyglycols include, but are not limited to, polyethylene glycol; polypropylene glycol (PPG); polybutylene glycol; pentane glycol; hexane glycol; benzene glycol; xylene glycol; 2,3-dimethyl-2,3-butane diol; dipropylene glycol; and their polymers. Suitable amine chain extenders include, but are not limited to, tetramethyl-ethylenediamine; dimethylbenzylamine; diethylbenzylamine; pentamethyldiethylenetriamine; dimethyl cyclohexylamine; tetramethyl-1,3-butanediamine; pentamethyldipropylenetriamine; 1,2-dimethylimidazole; 2-methylimidazole; and bis-(dimethylaminoethyl)ether. In specific embodiments, the reaction mixture further comprises polypropylene glycol (PPG) or polytetramethylene ether glycol (PTMEG).

In addition to these polyols and chain extenders, other reactants containing a reactive hydrogen atom that would react with the isocyanate to form the polyurethane/polyurea can be utilized. Such materials include polyamines, polyamides, short oil alkyds, castor oil, epoxy resins with secondary hydroxyl groups, phenolic resins, and hydroxyl functional vinyl resins. Suitable examples of such materials include ANCAMINE 2071, a modified polyamine marketed by Pacific Anchor Chemical Corporation, Los Angeles, Calif.; EPON V-40, a polyamide marketed by Shell Oil Company, Houston, Tex.; AROPLAZ 1133-X-69, a short oil alkyd by Reichhold Inc., Minneapolis, Minn.; EPON resin 828, an epoxy resin marketed by Shell Oil Company; PENTALYN 802A, a phenolic modified polyester resin marketed by Hercules Inc., Wilmington, Del.; and VAGH, a hydroxyl functional vinyl resin marketed by Union Carbide, Danbury, Conn.

The polyol component may also contains additives, such as stabilizers, flow modifiers, catalysts, moisture scavengers, molecular sieves, combustion modifiers, blowing agents, fillers, pigments, optical brighteners, and release agents to modify the physical characteristics of the product.

In other embodiments, the polyurethane incorporates TMXDI ("META") aliphatic isocyanate (Cytec Industries, West Paterson, N.J.). Polyurethanes based on meta-tetramethylxylylene diisocyanate (TMXDI) can provide improved gloss retention UV light stability, thermal stability, and hydrolytic stability. Additionally, TMXDI ("META") aliphatic isocyanate has demonstrated favorable toxicological properties. Furthermore, because it has a low viscosity, it is usable with a wider range of diols (to polyurethane) and diamines (to polyureas). If TMXDI is used, it typically, but not necessarily, is added as a direct replacement for some or all of the other aliphatic isocyanates in accordance with the suggestions of the supplier. Because of slow reactivity of TMXDI, it may be useful or necessary to use catalysts to have practical demolding times. Hardness, tensile strength and elongation can be adjusted by adding further materials in accordance with the supplier's instructions.

Typically, there are two classes of thermoplastic polyurethane materials: aliphatic polyurethanes and aromatic polyurethanes. The aliphatic materials are produced from a polyol or polyols and aliphatic isocyanates, such as H12MDI or HDI, and the aromatic materials are produced from a polyol or polyols and aromatic isocyanates, such as MDI or TDI. The thermoplastic polyurethanes may also be produced from a blend of both aliphatic and aromatic materials, such as a blend of HDI and TDI with a polyol or polyols.

Generally, the aliphatic thermoplastic polyurethanes are lightfast, meaning that they do not yellow appreciably upon exposure to ultraviolet light. Conversely, aromatic thermoplastic polyurethanes tend to yellow upon exposure to ultraviolet light. One method of stopping the yellowing of the aromatic materials is to paint the outer surface of the finished ball with a coating containing a pigment, such as titanium dioxide, so that the ultraviolet light is prevented from reaching the surface of the ball. Another method is to add UV absorbers, optical brighteners and stabilizers to the clear coating(s) on the outer cover, as well as to the thermoplastic polyurethane material itself. By adding UV absorbers and stabilizers to the thermoplastic polyurethane and the coating(s), aromatic polyurethanes can be effectively used in the outer cover layer of golf balls. This is advantageous because aromatic polyurethanes typically have better scuff resistance characteristics than aliphatic polyurethanes, and the aromatic polyurethanes typically cost less than the aliphatic polyurethanes.

Other suitable polyurethane materials include reaction injection molded ("RIM") polyurethanes. RIM is a process by which highly reactive liquids are injected into a mold, mixed usually by impingement and/or mechanical mixing in an in-line device such as a "peanut mixer," where they polymerize primarily in the mold to form a coherent, one-piece molded article. The RIM process usually involves a rapid reaction between one or more reactants such as a polyether polyol or polyester polyol, polyamine, or other material with an active hydrogen, and one or more isocyanate-containing reactants, often in the presence of a catalyst. The reactants are stored in separate tanks prior to molding and may be first mixed in a mix head upstream of a mold and then injected into the mold. The liquid streams are metered in the desired weight to weight ratio and fed into an impingement mix head, with mixing occurring under high pressure, for example, 1,500 to 3,000 psi. The liquid streams impinge upon each other in the mixing chamber of the mix head and the mixture is injected into the mold. One of the liquid streams typically contains a catalyst for the reaction. The reactants react rapidly after mixing to gel and form polyurethane polymers. Polyureas, epoxies, and various unsaturated polyesters also can be molded by RIM. Further descriptions of suitable RIM systems is disclosed in U.S. Pat. No. 6,663,508, which pertinent parts are hereby incorporated by reference.

Non-limiting examples of suitable RIM systems for use in the present disclosure are VIBRARIM reaction injection moldable polyurethane and polyurea systems from Crompton corporation (Middlebury, Conn.), BAYFLEX elastomeric polyurethane RIM systems, BAYDUR GS solid polyurethane RIM systems, PRISM solid polyurethane RIM systems, all from Bayer Corp. (Pittsburgh, Pa.), SPECTRIM reaction moldable polyurethane and polyurea systems from Dow Chemical USA (Midland, Mich.), including SPECTRIM MM 373-A (isocyanate) and 373-B (polyol), and ELASTOLIT SR systems from BASF (Parsippany, N.J.). Preferred RIM systems include VibraRIM 813 from Crompton/Uniroyal. Further preferred examples are polyols, polyamines and isocyanates formed by processes for recycling polyurethanes and polyureas. Additionally, these various systems may be modified by incorporating a butadiene component in the diol agent or in the prepolymer agent.

The polyurethane cover may have indicia and/or logos stamped or formed thereon. Such indicia can be applied by printing using a material or a source of energetic particles after the cover has been produced. Printed indicia can be formed from materials known in the art, such as ink, foil (for use in foil transfer), etc. Indicia printed using a source of energetic particles or radiation can be applied by burning with a laser, burning with heat, directed electrons, or light, phototransformations of, e.g., U.V. ink, impingement by particles, impingement by electromagnetic radiation, etc. Furthermore, the indicia can be applied in the same manner as an in-mold coating, i.e., by applying the indicia to the surface of the mold prior to molding of the cover.

The resulting cover comprises from about 5 to about 100 weight percent of polyurethane based on the weight of the cover. It may have pigments or dyes, accelerators, or UV stabilizers added to it prior to molding. An example of a suitable white pigment is titanium dioxide. Examples of suitable UV light stabilizers are provided in commonly assigned U.S. Pat. No. 5,494,291, herein totally incorporated by reference. Furthermore, compatible polymeric materials can be added. For example, when the component comprises polyurethane and/or polyurea, such polymeric materials include polyurethane ionomers, polyamides, etc. Fillers can also be incorporated into the golf ball component as described above.

In one embodiment, the cover layer is comprised of a relatively soft, low flex modulus (about 500 psi to about 50,000 psi, preferably about 1,000 psi to about 25,000 psi, and more preferably about 5,000 psi to about 20,000 psi) material or blend of materials. Preferably, the cover layer comprises a polyurethane, a polyurea, a blend of two or more polyurethanes/polyureas, or a blend of one or more ionomers or one or more non-ionomeric thermoplastic materials with a polyurethane/polyurea, preferably a reaction injection molded polyurethane/polyurea.

The cover layer usually has a thickness in the range of 0.005 inch to about 0.250 inch, more preferably about 0.010 inch to about 0.090 inch, and most preferably 0.015 inch to 0.040 inch.

The cover layer may comprise a polyurethane with a Shore C hardness of from about 10 to about 95, more preferably from about 20 to about 90, and most preferably from about 30 to about 85 for a soft cover layer and a Shore D hardness from about 50 to about 85, preferably about 55 to about 80, and more preferably about 60 to about 75 for a hard cover layer.

The polyurethane preferably has a flex modulus from about 1 to about 100 Kpsi, more preferably from about 2 to about 80 Kpsi, and most preferably from about 3 to about 60 Kpsi for a soft cover layer. For a hard cover layer, it preferably has a flex modulus from about 30 to about 310 Kpsi, more preferably from about 40 to about 250 Kpsi, and most preferably from about 45 to about 200 Kpsi.

In a more preferred embodiment, the cover comprises a relatively soft thermoset polyurethane/polyurea material that is produced by RIM. The cover layer is thin enough to produce the enhanced playability characteristics desired without raising significant durability issues (scuff, abrasion, cut, etc.). In this regard, a cover thickness of from about 0.005" to about 0.045" is desirable.

The resulting golf ball of the present disclosure has excellent properties. The golf ball preferably has a diameter of 1.680 inches or more, the minimum permitted by the U.S.G.A; however, oversize balls are within the present invention. In some embodiments, the diameter of the golf ball is from 1.680 inches to about 1.780 inches. The golf ball preferably has a mass no more than 1.62 ounces. The golfball preferably has low driver spin and excellent greenside spin as measured using a GOLFLABS mechanical hitting robot and a TRACKMAN radar based measurement system from ISG. The golf ball preferably has a high initial velocity of between 250 and 255 feet/sec. The golfball preferably has a COR of from about 0.600 to about 0.850, including from about 0.700 to about 0.830, and from about 0.770 to about 0.820.

In preferred embodiments, the golf ball has a dimple pattern that provides dimple coverage of 65% or more, preferably 75% or more, and more preferably about 80 to 85% or more. In another embodiment, there are from 300 to less than 500 dimples, preferably from about 340 to about 440 dimples. In yet another embodiment, the golf ball has an aerodynamic pattern such as disclosed in U.S. Pat. No. 6,290,615, which is hereby incorporated by reference in its entirety.

Specifically, the arrangement and total number of dimples are not critical and may be properly selected within ranges that are well known. For example, the dimple arrangement may be an octahedral, dodecahedral or icosahedral arrangement. The total number of dimples is generally from about 250 to about 600, and especially from about 300 to about 500.

In other embodiments, the golf ball is coated with a durable, abrasion-resistant, relatively non-yellowing finish coat or coats if necessary. The finish coat or coats may have some optical brightener and/or pigment added to improve the brightness of the finished golf ball. In one embodiment, from 0.001 to about 10% optical brightener may be added to one or more of the finish coatings. If desired, optical brightener may also be added to the cover materials. One type of preferred finish coatings are solvent based urethane coatings known in the art. It is also contemplated to provide a transparent outer coating or layer on the final finished golf ball.

Golf balls also typically include logos and other markings printed onto the dimpled spherical surface of the ball. Paint, typically clear paint, is applied for the purposes of protecting the cover and improving the outer appearance before the ball is completed as a commercial product.

In a further exemplary embodiment, the golf ball has a molded core comprising a high cis-polybutadiene crosslinked with zinc diacrylate. The ionomer mantle covering the core is neutralized to greater than 80%, including from about 90% to about 100%. In embodiments comprising more than one mantle, the ionomer outer cover or skin has a high flex modulus. In an alternative embodiment, the inner mantle comprises an ionomer and the outer mantle or skin comprises an ionomeric material neutralized to greater than 80%, including from about 90% to about 100%. The polyurethane cover is a RIM cover. In a further embodiment, the polyurethane cover has a hardness less than that of the ionomer mantle; this results in a golf ball having low driver spin, but high spin around the greens, which is desirable for golfers looking for a combination of distance and control. In a different embodiment, the ionomer mantle has a hardness less than the polyurethane cover (hard over soft construction); this results in a golf ball having low spin across all shots and a lower compression (softer), which is better suited to golfers looking for straighter shots and a softer feel.

Specific embodiments of the disclosure will now be described in detail. These examples are intended to be illustrative, and the disclosure is not limited to the materials, conditions, or process parameters set forth in these embodiments. All parts and percentages are by weight unless otherwise indicated.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

The invention claimed is:

1. A golf ball, comprising:

a molded core comprising a high cis-polybutadiene having a Mooney viscosity of from about 20 to about 70 and an Instron compression of greater than 0.0880;

an inner mantle comprising an ionomer neutralized to 80% or more and having a Shore D hardness of from about 30 to about 85, the inner mantle molded on the molded core;

an outer mantle comprising an ionomer having a Shore D hardness of from about 30 to about 85, the outer mantle molded on the inner mantle, the outer mantle having a thickness ranging from 0.025 inch to 0.065 inch;

and a thermoset polyurethane/polyurea cover formed over the outer mantle, the thermoset polyurethane/polyurea cover having a thickness ranging from 0.015 inch to 0.040 inch.

2. The golf ball of claim 1, wherein the core has a COR of from about 0.600 to about 0.850.

3. The golf ball of claim 2, wherein the core further comprises a peptizer.

4. The golf ball of claim 3, wherein the core further comprises a metal thiosulfate.

5. The golf ball of claim 3, wherein the peptizer is pentachlorothiophenol or a metallic salt thereof.

6. The golf ball of claim 4, wherein the metal thiosulfate is disodium hexamethylene thiosulfate dihydrate.

7. The golf ball of claim 1, wherein the ionomer of the inner mantle is neutralized to about 90% or more.

8. The golf ball of claim 1, wherein the ionomer of the inner mantle is neutralized to about 100%.

9. The golf ball of claim 1, wherein the ionomer of the inner mantle is modified with a fatty acid or a salt thereof.

10. The golf ball of claim 9, wherein the fatty acid is stearic acid, oleic acid, a metal stearate, or a metal oleate.

11. The golf ball of claim 1, wherein the starting material of the inner mantle comprises an ethylene copolymer, an ethylene terpolymer or blends thereof.

12. The golf ball of claim 11, wherein the starting material of the inner mantle comprises a copolymer of ethylene and ethylene acrylate.

13. The golf ball of claim 1, wherein the outer mantle has a flex modulus of from about 0.5 to about 310 kpsi.

14. The golf ball of claim 1, wherein the polyurethane/polyurea cover is a cast or reaction-injection-molded cover.

15. The golf ball of claim 1, wherein the polyurethane/polyurea cover has a Shore C hardness of from about 10 to about 95.

16. A golf ball, comprising:

a molded core comprising a high cis-polybutadiene having a Mooney viscosity of from about 20 to about 70 and an Instron compression of greater than 0.0880;

an inner mantle comprising an ionomer having a Shore D hardness of from about 30 to about 85, the inner mantle molded on the molded core;

an outer mantle comprising an ionomer neutralized to 80% or more and having a Shore D hardness of from about 30 to about 85, the outer mantle molded on the inner mantle, the outer mantle having a thickness ranging from 0.025 inch to 0.065 inch;

and a therinoset polyurethane/polyurea cover fonned over the outer mantle, the thermoset polyurethane/polyurea cover having a thickness ranging from 0.015 inch to 0.040 inch.

17. The golf ball of claim 16, wherein the core has a COR of from about 0.600 to about 0.850.

18. The golf ball of claim 17, wherein the core further comprises a peptizer.

19. The golf ball of claim 16, wherein the ionomer of the outer mantle is neutralized to about 90% or more.

20. The golf ball of claim 16, wherein the ionomer of the outer mantle is neutralized to about 100%.

21. The golf ball of claim 16, wherein the ionomer of the outer mantle is modified with a fatty acid or a salt thereof.

22. The golf ball of claim 21, wherein the fatty acid is stearic acid, oleic acid, a metal stearate, or a metal oleate.

23. A golf ball, comprising:

a molded core comprising a high cis-polybutadiene, pentachlorothiophenol or a metallic salt thereof and an optional disodium hexamethylene thiosulfate dehydrate;

an inner mantle including an ionomer resin comprising a copolymer of ethylene and ethylene acrylate neutralized to 80% or greater;

an ionomer skin having a flex modulus of from about 0.5 to about 310 kpsi, the ionomer skin molded on the inner mantle, the ionomer skin having a thickness ranging from 0.025 inch to 0.065 inch;

and a thermoset polyurethane/polyurea cover produced by reaction-injection molding formed over the ionomer skin, the thermoset polyurethane/polyurea cover having a thickness ranging from 0.015 inch to 0.040 inch.

* * * * *